US011806589B2

(12) United States Patent
Nicolette et al.

(10) Patent No.: US 11,806,589 B2
(45) Date of Patent: Nov. 7, 2023

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Michael R. Nicolette, Scottsdale, AZ (US); Bradley D. Schweigert, Cave Creek, AZ (US); Caleb S. Kroloff, Phoenix, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/141,234

(22) Filed: Apr. 28, 2023

(65) Prior Publication Data

US 2023/0264078 A1 Aug. 24, 2023

Related U.S. Application Data

(63) Continuation-in-part of application No. 18/114,309, filed on Feb. 27, 2023, and a continuation-in-part of (Continued)

(51) Int. Cl.
*A63B 53/04* (2015.01)
*A63B 60/02* (2015.01)

(52) U.S. Cl.
CPC ..... *A63B 53/0466* (2013.01); *A63B 53/04* (2013.01); *A63B 60/02* (2015.10); (Continued)

(58) Field of Classification Search
CPC ..... A63B 53/0466; A63B 60/02; A63B 53/04; A63B 2053/0491; A63B 53/0408; A63B 53/0412; A63B 53/0433; A63B 53/0437; A63B 53/045; A63B 53/0454; A63B 53/042; A63B 53/0425; A63B 53/0429 (Continued)

(56) References Cited

U.S. PATENT DOCUMENTS 1,133,129 A 3/1915 Govan
1,269,745 A 6/1918 Robertson
(Continued)

FOREIGN PATENT DOCUMENTS

CN 1572343 A 2/2005
CN 1608696 A 4/2005
(Continued)

*Primary Examiner* — Sebastiano Passaniti

(57) ABSTRACT

Embodiments of golf club heads and methods to manufacture golf club heads are generally described herein. In one example, a golf club head may include a body portion having an interior cavity and a front portion. The golf club head may include a face portion on the front portion and having a front surface and a back surface with a center portion and a perimeter portion at least partially surrounding the center portion. The golf club head may include a face bracket portion having at least one bracket arm with end portions attached to the perimeter portion. The golf club head may further include a face insert portion located between and coupled to the back surface of the face portion and to the face bracket portion. Other examples and embodiments may be described and claimed.

20 Claims, 22 Drawing Sheets

Related U.S. Application Data application No. 17/886,655, filed on Aug. 12, 2022, said application No. 18/114,309 is a continuation of application No. 17/876,746, filed on Jul. 29, 2022, which is a continuation-in-part of application No. 17/586,971, filed on Jan. 28, 2022, which is a continuation-in-part of application No. 17/528,436, filed on Nov. 17, 2021, which is a continuation-in-part of application No. 17/198,770, filed on Mar. 11, 2021, said application No. 17/586,971 is a continuation of application No. 17/149,954, filed on Jan. 15, 2021, said application No. 17/198,770 is a continuation of application No. 16/807,591, filed on Mar. 3, 2020.

(60) Provisional application No. 63/343,709, filed on May 19, 2022, provisional application No. 63/316,145, filed on Mar. 3, 2022, provisional application No. 63/289,908, filed on Dec. 15, 2021, provisional application No. 63/232,767, filed on Aug. 13, 2021, provisional application No. 63/117,182, filed on Nov. 23, 2020, provisional application No. 62/963,430, filed on Jan. 20, 2020, provisional application No. 62/957,757, filed on Jan. 6, 2020, provisional application No. 62/897,015, filed on Sep. 6, 2019, provisional application No. 62/873,773, filed on Jul. 12, 2019, provisional application No. 62/837,592, filed on Apr. 23, 2019, provisional application No. 62/820,728, filed on Mar. 19, 2019, provisional application No. 62/816,418, filed on Mar. 11, 2019.

(52) U.S. Cl.
CPC ..... *A63B 53/045* (2020.08); *A63B 53/0408* (2020.08); *A63B 53/0412* (2020.08); *A63B 53/0433* (2020.08); *A63B 53/0437* (2020.08); *A63B 2053/0491* (2013.01)

(58) Field of Classification Search
USPC ..... 473/342, 346, 409
See application file for complete search history.

(56) References Cited

U.S. PATENT DOCUMENTS 1,306,029 A 6/1919 Robertson
1,534,600 A 4/1925 Mattern
1,538,312 A 5/1925 Neish
3,652,094 A 3/1972 Glover
4,085,934 A 4/1978 Churchward
1,502,687 A 3/1985 Kochevar
4,545,580 A 10/1985 Tomita et al.
4,591,160 A 5/1986 Piragino
4,614,627 A 9/1986 Curtis et al.
4,803,023 A 2/1989 Enomoto et al.
4,824,116 A 4/1989 Nagamoto et al.
4,883,623 A 11/1989 Nagamoto et al.
4,988,104 A 1/1991 Shiotani et al.
5,090,702 A 2/1992 Viste
5,106,094 A 4/1992 Desbiolles et al.
5,213,328 A 5/1993 Long et al.
5,219,408 A 6/1993 Sun
5,244,211 A 9/1993 Lukasiewicz
5,306,450 A 4/1994 Okumoto et al.
5,351,958 A 10/1994 Helmstetter
5,419,559 A 5/1995 Melanson et al.
5,421,577 A 6/1995 Kobayashi
5,451,056 A 9/1995 Manning
5,467,983 A 11/1995 Chen
5,485,998 A 1/1996 Kobayashi
5,505,453 A * 4/1996 Mack ..... A63B 53/0466 473/329
5,518,243 A 5/1996 Redman
5,564,994 A * 10/1996 Chang ..... A63B 60/00 473/345
5,624,331 A 4/1997 Lo et al.
5,637,045 A 6/1997 Igarashi
5,649,873 A 7/1997 Fuller
5,669,829 A * 9/1997 Lin ..... A63B 53/0466 473/346
D386,550 S 11/1997 Wright et al.
D386,551 S 11/1997 Solheim et al.
D387,405 S 12/1997 Solheim et al.
5,718,645 A * 2/1998 Chang ..... A63B 60/00 473/342
5,766,092 A 6/1998 Mimeur et al.
5,769,735 A 6/1998 Hosokawa
5,788,584 A 8/1998 Parente et al.
5,797,807 A 8/1998 Moore
5,971,868 A 10/1999 Kosmatka
5,997,415 A 12/1999 Wood
6,042,486 A 3/2000 Gallagher
6,077,171 A 6/2000 Yoneyama
6,146,287 A 11/2000 Rugge et al.
6,162,133 A 12/2000 Peterson
6,165,081 A 12/2000 Chou
6,231,458 B1 5/2001 Cameron et al.
6,280,349 B1 8/2001 Cook
6,306,048 B1 10/2001 McCabe et al.
6,368,234 B1 4/2002 Galloway
6,379,262 B1 4/2002 Boone
6,386,990 B1 5/2002 Reyes et al.
6,409,612 B1 6/2002 Evans et al.
6,413,169 B1 7/2002 Kosmatka
6,435,977 B1 8/2002 Helmstetter et al.
6,454,665 B2 9/2002 Antonious
6,471,604 B2 10/2002 Hocknell et al.
6,506,127 B2 1/2003 Helmstetter et al.
6,595,057 B2 7/2003 Bissonnette et al.
6,607,451 B2 8/2003 Kosmatka et al.
6,638,182 B2 10/2003 Kosmatka
6,641,491 B1 11/2003 Schillaci
6,695,714 B1 2/2004 Bliss et al.
6,729,971 B2 5/2004 Caldwell
6,746,343 B2 6/2004 Yoneyama
6,780,123 B2 8/2004 Hasebe
6,800,040 B2 10/2004 Galloway et al.
6,811,496 B2 11/2004 Wahl et al.
6,830,519 B2 12/2004 Reed et al.
6,835,144 B2 12/2004 Best
6,840,872 B2 1/2005 Yoneyama
6,852,038 B2 2/2005 Yabu
6,857,973 B2 2/2005 Wieland et al.
6,863,626 B2 3/2005 Evans et al.
6,904,663 B2 6/2005 Willett et al.
6,932,719 B2 8/2005 Yabu
6,979,270 B1 12/2005 Allen
6,984,180 B2 1/2006 Hasebe
6,986,715 B2 1/2006 Mahaffey
6,991,560 B2 1/2006 Tseng
6,997,821 B2 2/2006 Galloway et al.
7,014,570 B2 3/2006 Evans et al.
7,041,003 B2 5/2006 Bissonnette et al.
7,082,665 B2 8/2006 Deshmukh et al.
7,083,530 B2 8/2006 Wahl et al.
7,101,289 B2 9/2006 Gibbs et al.
7,121,956 B2 10/2006 Lo
7,125,344 B2 10/2006 Hocknell et al.
7,137,903 B2 11/2006 Best et al.
7,137,907 B2 11/2006 Gibbs et al.
7,153,220 B2 12/2006 Lo
7,169,062 B2 1/2007 Chen
7,182,698 B2 2/2007 Tseng
7,186,190 B1 3/2007 Beach et al.
7,192,364 B2 * 3/2007 Long ..... A63B 53/04 473/345
7,214,142 B2 5/2007 Meyer et al.
7,220,189 B2 5/2007 Wieland et al.
7,223,180 B2 5/2007 Willett et al.
7,258,625 B2 8/2007 Kawaguchi et al.
7,258,626 B2 8/2007 Gibbs et al.

(56) References Cited

U.S. PATENT DOCUMENTS 7,338,388 B2 3/2008 Schweigert et al.
7,347,794 B2 3/2008 Schweigert
7,367,897 B2 5/2008 Poynor
7,384,348 B2 * 6/2008 Lin ..... A63B 60/00 473/332
7,387,579 B2 6/2008 Lin et al.
7,419,441 B2 9/2008 Hoffman et al.
7,422,528 B2 9/2008 Gibbs et al.
7,435,190 B2 10/2008 Sugimoto
7,442,132 B2 10/2008 Nishio
7,448,960 B2 11/2008 Gibbs et al.
7,448,964 B2 11/2008 Schweigert et al.
7,494,426 B2 2/2009 Nishio et al.
7,524,249 B2 4/2009 Breier et al.
7,527,565 B1 5/2009 Ehlers et al.
7,572,193 B2 8/2009 Yokota
7,575,524 B2 8/2009 Willett et al.
7,582,024 B2 9/2009 Shear
7,584,531 B2 9/2009 Schweigert et al.
7,594,862 B2 9/2009 Gilbert
7,611,424 B2 11/2009 Nagai et al.
7,618,331 B2 11/2009 Hirano
7,641,568 B2 1/2010 Hoffman et al.
7,658,686 B2 2/2010 Soracco
7,713,140 B2 5/2010 Gibbs et al.
7,731,603 B2 6/2010 Beach et al.
7,744,484 B1 6/2010 Chao
7,785,212 B2 8/2010 Lukasiewicz et al.
7,794,333 B2 9/2010 Wallans et al.
7,798,203 B2 9/2010 Schweigert et al.
7,806,781 B2 10/2010 Imamoto
7,811,178 B2 10/2010 Davis
7,846,041 B2 12/2010 Beach et al.
7,871,339 B2 1/2011 Sanchez et al.
7,927,229 B2 4/2011 Jertson et al.
7,931,545 B2 * 4/2011 Soracco ..... A63B 60/42 473/345
7,935,000 B2 5/2011 Stites
8,007,369 B2 8/2011 Soracco
8,012,038 B1 9/2011 Beach et al.
8,012,040 B2 9/2011 Takechi
8,012,041 B2 9/2011 Gibbs et al.
8,016,691 B2 9/2011 Stites
8,070,623 B2 12/2011 Stites et al.
8,088,025 B2 1/2012 Wahl et al.
8,096,896 B2 1/2012 Schiell et al.
8,187,116 B2 5/2012 Boyd et al.
8,192,303 B2 6/2012 Ban
8,197,357 B1 6/2012 Rice et al.
8,202,175 B2 6/2012 Ban
8,226,498 B2 7/2012 Stites et al.
8,235,843 B1 8/2012 Rice et al.
8,257,196 B1 9/2012 Abbott et al.
8,262,506 B2 9/2012 Watson et al.
8,287,402 B2 10/2012 Shiell et al.
8,353,783 B2 1/2013 Soracco
8,353,787 B2 1/2013 Meyer et al.
8,371,957 B2 2/2013 Schweigert et al.
8,376,876 B2 2/2013 Gibbs et al.
8,403,769 B2 3/2013 Stites
8,414,422 B2 4/2013 Peralta et al.
8,430,763 B2 4/2013 Beach et al.
8,439,769 B2 5/2013 Rice et al.
8,444,506 B2 5/2013 Watson et al.
8,449,406 B1 5/2013 Frame et al.
8,469,834 B2 6/2013 Wada et al.
8,480,512 B2 7/2013 Oldknow et al.
8,485,919 B2 7/2013 Rice et al.
8,540,590 B2 9/2013 Tsukada et al.
8,545,343 B2 10/2013 Boyd et al.
8,568,248 B2 10/2013 DeShiell et al.
8,602,912 B2 12/2013 Stites
8,628,431 B2 1/2014 Schweigert et al.
8,651,975 B2 2/2014 Soracco
8,657,701 B2 2/2014 Boyd et al.
8,663,026 B2 3/2014 Blowers et al.
8,696,489 B2 4/2014 Gibbs et al.
8,734,265 B2 5/2014 Soracco
8,784,232 B2 7/2014 Jertson et al.
8,790,196 B2 7/2014 Solheim et al.
8,814,724 B2 8/2014 Kato
8,826,512 B2 9/2014 Schweigert
8,845,454 B2 9/2014 Boyd et al.
8,858,362 B1 10/2014 Leposky et al.
8,888,607 B2 11/2014 Harbert et al.
8,900,069 B2 12/2014 Beach et al.
8,900,072 B1 12/2014 Willett et al.
8,915,794 B2 12/2014 Stites
8,956,247 B2 * 2/2015 Morin ..... A63B 53/0466 473/345
8,979,671 B1 3/2015 Demille et al.
9,022,880 B2 5/2015 Kawaguchi et al.
9,033,819 B2 5/2015 Wahl et al.
9,033,820 B2 5/2015 Kato
9,089,746 B2 7/2015 Schweigert
9,101,808 B2 8/2015 Stites et al.
9,101,809 B2 8/2015 Gibbs et al.
9,162,119 B2 * 10/2015 Park ..... A63B 60/00
9,168,436 B2 10/2015 Slaughter et al.
9,199,138 B2 12/2015 Willett et al.
9,199,140 B1 12/2015 Schweigert et al.
9,199,143 B1 12/2015 Parsons et al.
9,242,152 B2 1/2016 Cole et al.
9,327,173 B2 5/2016 Mizutani
9,352,197 B2 5/2016 Parsons et al.
9,393,471 B2 7/2016 Beno et al.
9,399,157 B2 7/2016 Greensmith et al.
9,399,158 B2 7/2016 Parsons et al.
9,403,069 B2 8/2016 Boyd et al.
9,452,325 B2 9/2016 DeShiell et al.
9,468,821 B2 10/2016 Parsons et al.
9,533,201 B2 1/2017 Parsons et al.
9,550,096 B2 1/2017 Parsons et al.
9,573,027 B2 2/2017 Nivanh et al.
9,610,481 B2 4/2017 Parsons et al.
9,630,070 B2 4/2017 Parsons et al.
9,649,542 B2 5/2017 Nicolette
9,669,270 B2 6/2017 Schweigert et al.
9,675,853 B2 6/2017 Parsons et al.
9,682,295 B1 6/2017 Dawson et al.
9,700,764 B2 7/2017 Carter
9,717,959 B2 8/2017 Stites
9,782,643 B2 10/2017 Parsons et al.
9,795,842 B1 10/2017 Parsons et al.
9,814,952 B2 11/2017 Parsons et al.
9,814,954 B2 11/2017 Westrum et al.
9,821,201 B1 11/2017 Parsons et al.
9,833,667 B1 12/2017 Parsons et al.
9,839,817 B1 12/2017 Johnson et al.
9,839,821 B2 12/2017 Deshiell et al.
9,844,710 B2 12/2017 Parsons et al.
9,861,867 B2 1/2018 Parsons et al.
9,937,388 B2 4/2018 Cardani et al.
9,981,160 B2 5/2018 Parsons et al.
9,993,704 B2 6/2018 Hebreo et al.
10,150,020 B2 12/2018 Cole et al.
10,213,659 B2 2/2019 Parsons et al.
10,328,319 B2 6/2019 Nakamura
10,376,754 B2 8/2019 Parsons et al.
10,413,787 B2 9/2019 Parsons et al.
10,449,428 B2 10/2019 Parsons et al.
10,478,684 B2 11/2019 Parsons et al.
10,512,829 B2 12/2019 Parsons et al.
10,583,336 B2 3/2020 Parsons et al.
10,596,425 B2 3/2020 Parsons et al.
10,632,349 B2 4/2020 Parsons et al.
10,722,765 B2 7/2020 Schweigert et al.
10,729,948 B2 8/2020 Parsons et al.
10,729,949 B2 8/2020 Parsons et al.
10,828,538 B2 11/2020 Parsons et al.
10,874,921 B2 12/2020 Parsons et al.
10,905,920 B2 2/2021 Parsons et al.
10,905,925 B2 2/2021 Morales et al.
10,933,286 B2 3/2021 Parsons et al.

(56) References Cited

U.S. PATENT DOCUMENTS 10,960,274 B2 3/2021 Parsons et al.
10,967,231 B2 4/2021 Parsons et al.
11,117,028 B2 9/2021 Parsons et al.
11,154,755 B2 10/2021 Parsons et al.
11,167,187 B2 11/2021 Parsons et al.
11,192,003 B2 12/2021 Parsons et al.
11,266,888 B2 3/2022 Kroloff et al.
11,344,775 B2 5/2022 Parsons et al.
11,369,847 B2 6/2022 Parsons et al.
11,400,352 B1 8/2022 Parsons et al.
11,458,372 B2 10/2022 Parsons et al.
11,484,756 B2 11/2022 Parsons et al.
11,541,288 B2 1/2023 Parsons et al.
11,565,158 B1 1/2023 Parsons et al.
11,617,925 B2 4/2023 Parsons et al.
2002/0019265 A1 2/2002 Allen
2003/0027662 A1 2/2003 Werner et al.
2003/0148818 A1 8/2003 Myrhum et al.
2003/0190975 A1* 10/2003 Fagot ..... A63B 53/047 473/346
2004/0087388 A1 5/2004 Beach et al.
2004/0192468 A1 9/2004 Onoda et al.
2004/0266550 A1 12/2004 Gilbert et al.
2005/0096154 A1 5/2005 Chen
2005/0250596 A1 11/2005 Chuang
2006/0052181 A1 3/2006 Serrano et al.
2006/0100031 A1 5/2006 Lan
2006/0229141 A1 10/2006 Galloway
2007/0129161 A1 6/2007 Matsunaga et al.
2008/0004129 A1 1/2008 Lin et al.
2008/0004130 A1* 1/2008 Lin ..... A63B 53/0466 473/342
2008/0004133 A1 1/2008 Schweigert
2008/0015047 A1* 1/2008 Rice ..... A63B 60/00 473/329
2008/0022502 A1 1/2008 Tseng
2008/0064523 A1* 3/2008 Chen ..... A63B 53/06 473/345
2008/0108452 A1* 5/2008 Chiang ..... A63B 53/0466 29/530
2008/0234067 A1* 9/2008 Lo ..... A63B 53/047 473/350
2009/0105007 A1* 4/2009 Lin ..... A63B 53/0466 473/332
2010/0105501 A1* 4/2010 Wada ..... A63B 53/0466 473/349
2010/0113178 A1* 5/2010 Stites ..... A63B 53/06 473/282
2010/0144461 A1 6/2010 Ban
2010/0331102 A1 12/2010 Golden et al.
2012/0064994 A1 3/2012 Wada et al.
2012/0283036 A1* 11/2012 Stites ..... A63B 60/00 473/329
2013/0040757 A1* 2/2013 Deshmukh ..... A63B 53/0466 473/342
2013/0274030 A1* 10/2013 Roach ..... A63B 60/00 473/342
2015/0126305 A1 5/2015 Stokke et al.
2015/0290503 A1 10/2015 Su
2016/0038799 A1 2/2016 Cruz et al.
2018/0296887 A1 10/2018 Motokawa
2022/0072393 A1 3/2022 Parsons et al.

FOREIGN PATENT DOCUMENTS

CN 1302216 C 2/2007
CN 102143783 A 8/2011
CN 203108126 U 8/2013
CN 203790537 U 8/2014
DE 29715997 U1 2/1998
EP 1955740 A1 8/2008
GB 2249031 B 8/1994
JP S62200359 U 12/1987
JP H0241003 U 3/1990
JP H10277187 A 10/1998
JP H119742 A 1/1999
JP 2002143356 A 5/2002
JP 2002535056 A 10/2002
JP 2005287679 A 10/2005
JP 2006087783 A 4/2006
JP 2006223331 A 8/2006
JP 2007044445 A 2/2007
JP 2007136068 A 6/2007
JP 2008161597 A 7/2008
JP 2008173314 A 7/2008
JP 3158662 U 4/2010
JP 2010069106 A 4/2010
JP 2013027587 A 2/2013
JP 2013043091 A 3/2013
JP 2013188400 A 9/2013
JP 2013544178 A5 11/2015

* cited by examiner

GOLF CLUB HEADS AND METHODS TO MANUFACTURE GOLF CLUB HEADS

CROSS REFERENCE

This application is a continuation-in-part of application Ser. No. 17/198,770, filed Mar. 11, 2021, which is a continuation of application Ser. No. 16/807,591, filed Mar. 3, 2020, now U.S. Pat. No. 10,960,274, which claims the benefit of U.S. Provisional Application No. 62/837,592, filed Apr. 23, 2019, U.S. Provisional Application No. 62/873,773, filed Jul. 12, 2019, U.S. Provisional Application No. 62/897,015, filed Sep. 6, 2019, U.S. Provisional Application No. 62/820,728, filed Mar. 19, 2019, U.S. Provisional Application No. 62/816,418, filed Mar. 11, 2019, and U.S. Provisional Application No. 62/957,757, filed Jan. 6, 2020.

This application is a continuation-in-part of application Ser. No. 17/586,971, filed Jan. 28, 2022, which is a continuation of application Ser. No. 17/149,954, filed Jan. 15, 2021, now U.S. Pat. No. 11,266,888, which claims the benefit of U.S. Provisional Application No. 62/963,430, filed Jan. 20, 2020.

This application is a continuation-in-part of application Ser. No. 17/528,436, filed Nov. 17, 2021, which claims the benefit of U.S. Provisional Application No. 63/117,182, filed Nov. 23, 2020.

This application is a continuation-in-part of application Ser. No. 18/114,309, filed Feb. 27, 2023, which is a continuation of application Ser. No. 17/876,746, filed Jul. 29, 2022, now U.S. Pat. No. 11,617,925, which claims the benefit of U.S. Provisional Application No. 63/289,908, filed Dec. 15, 2021, and claims the benefit of U.S. Provisional Application No. 63/232,767, filed Aug. 13, 2021.

This application is a continuation-in-part of application Ser. No. 17/886,655, filed Aug. 12, 2022, which claims the benefit of U.S. Provisional Application No. 63/316,145, filed Mar. 3, 2022.

This application claims the benefit of U.S. Provisional Application No. 63/343,709, filed May 19, 2022.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
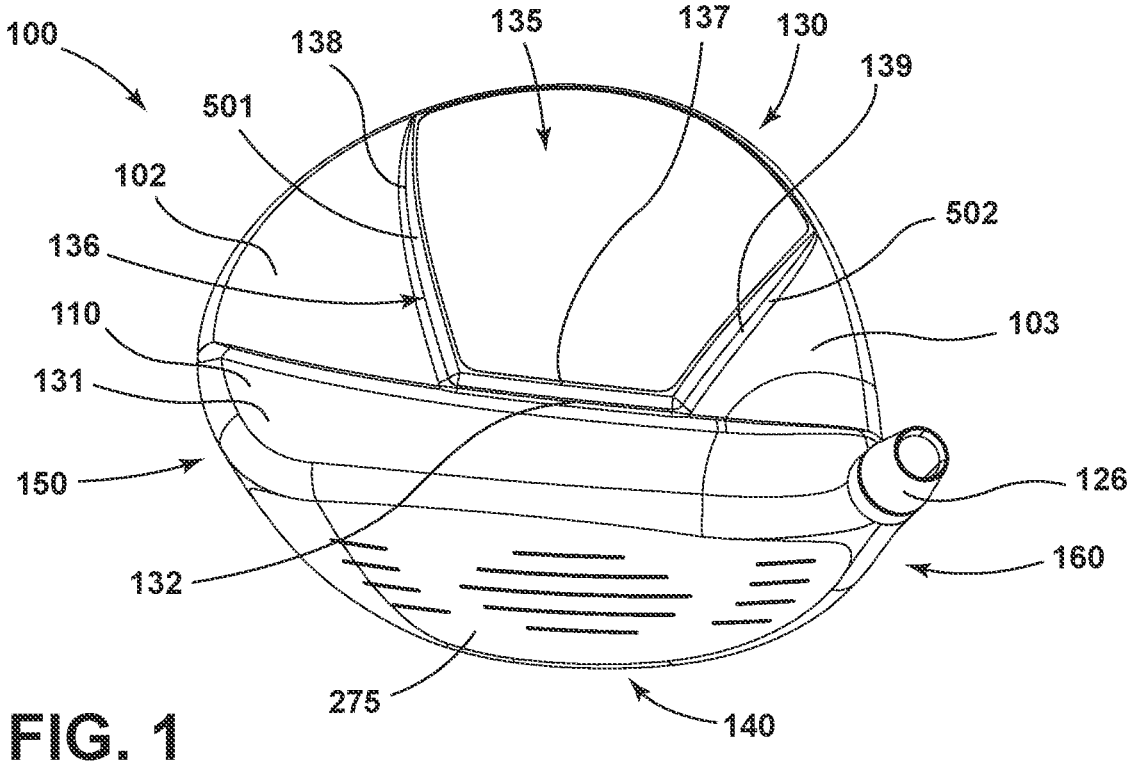
FIGS. 1, 2, 3, 4, 5, 6, 7, 8, 9, 10, 11, 12, and 13 illustrate a top perspective view, a bottom perspective view, a front view, a rear view, a top view, a bottom view, a heel side view, a toe side view, a cross-sectional view taken along section 9-9 of FIG. 5, a cross-sectional view taken along section 10-10, an exploded toe side view, an exploded rear view, and an exploded rear perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads, golf clubs, and methods to manufacture golf club heads and golf clubs are described herein. The following U.S. Patents and Patent Publications, which are collectively referred to herein as "the incorporated by reference patent documents," are incorporated by reference herein in their entirety: U.S. Pat. Nos. 9,352,197, 9,399,158, 9,550,096, 9,555,295, 9,630,070, 9,636,554, 9,662,547, 9,669,270, 9,782,643, 9,795,842, 9,795,843, 9,802,087, 9,814,945, 9,821,200, 9,821,201, 9,833,667, 9,861,867, 9,895,582, 9,895,583, 9,914,029, 9,981,160, 9,987,526, 9,999,814, 10,010,770, 10,052,532, 10,099,093, 10,143,899, 10,195,101, 10,213,659, 10,232,234, 10,252,123, 10,293,220, 10,293,221, 10,335,645, 10,376,754, 10,384,102, 10,413,787, 10,420,989, 10,420,990, 10,441,855, 10,532,257, 10,543,407, 10,583,336, 10,617,917, 10,617,918, 10,653,928, 10,695,623, 10,695,624, 10,709,942, 10,722,764, 10,722,765, 10,786,712, 10,821,334, 10,843,051, 10,898,766, 10,898,768, 10,926,142, 10,960,274, 10,960,275, 10,967,231, 10,981,037, 11,000,742, 11,103,755, 11,110,328, 11,117,028, 11,173,356, 11,266,888, 11,344,774, 11,484,756, and 11,617,925; and U.S. Patent Publications 20200206589, 20210138320, 20210197039, 20210197040, 20210205673, 20210228949, 20210354009, 20210370145, 20210379453, 20220040542, 20220072393, 20220152462, 20220379178, 20220387864, and 2023002096.

The apparatus, methods, and articles of manufacture described herein are not limited in this regard. In the example of FIGS. 1-13, a golf club head 100 may include a body portion 110 with a top portion 130, a crown portion 135, a sole portion 140, a toe portion 150, a heel portion 160, a front portion 170, and a rear portion 180. The sole portion 140 may include a skirt portion 190 defined as a side portion of the golf club head 100 between the top portion 130 and the sole portion 140 excluding the front portion 170 and extending across a periphery of the golf club head 100 from the toe portion 150, around the rear portion 180, and to the heel portion 160. Alternatively, the golf club head 100 may not include the skirt portion 190. The front portion 170 may include a face portion 275 to engage a golf ball. The face portion 275 may be integral to the body portion 110 or may be a separate face portion that is coupled (e.g., welded) to the front portion 170 to enclose an opening in the front portion 170. The body portion 110 may also include a hosel portion configured to receive a shaft portion (not shown). The hosel portion may be similar in many respects to any of the hosel portions described herein. The hosel portion may include an interchangeable hosel sleeve 126 and a fastener 127. Alternatively, the body portion 110 may include a bore instead of the hosel portion. The body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material. The apparatus, methods, and articles of manufacture described herein are not limited in this regard.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Figure 8:
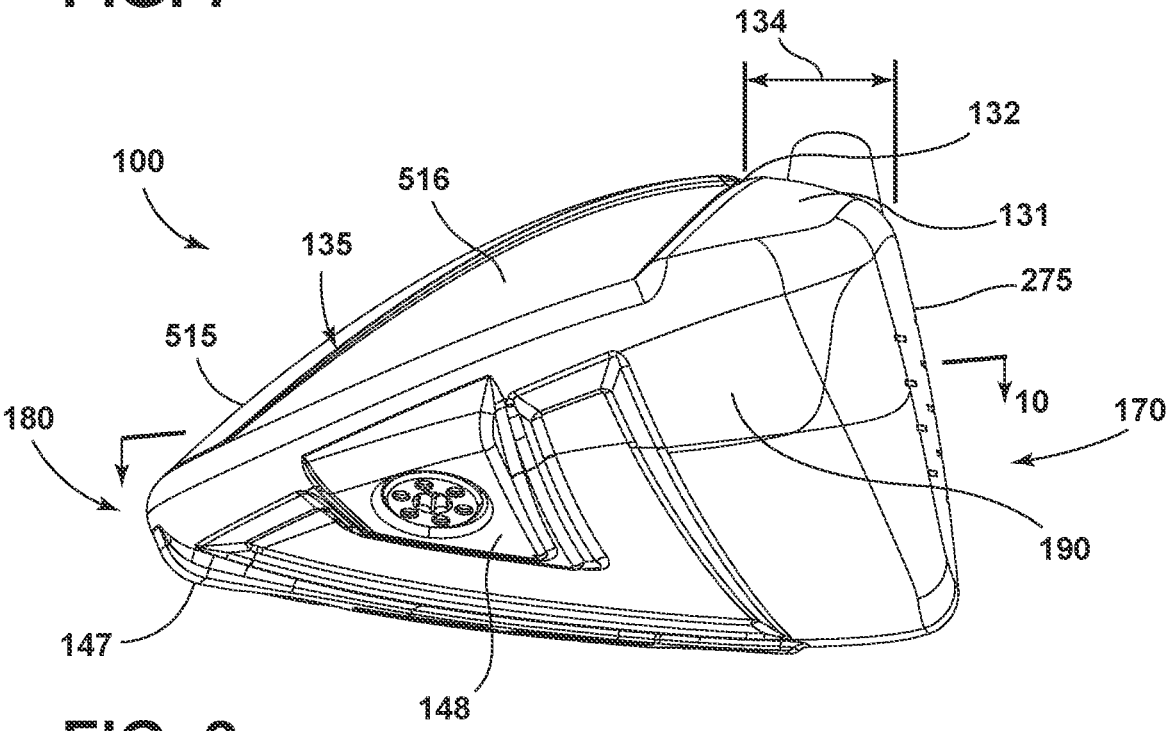

The top portion 130 may include a forward portion 131 extending a distance 134 between the front portion 170 and the crown portion 135, as shown in FIG. 8. In one example, the forward portion 131 may extend a distance 134 of at least 8 mm in a front-to-rear direction, resulting in the crown portion 135 being positioned at least 8 mm rearward of the face portion 275. In another example, the forward portion 131 may extend a distance 134 of at least 12 mm in a front-to-rear direction. In another example, the forward portion 131 may extend a distance 134 of at least 16 mm in a front-to-rear direction. In yet another example, the forward portion 131 may extend a distance 134 of at least 20 mm in a front-to-rear direction. In still another example, the forward portion 131 may extend a distance 134 of between and including 12 mm and 20 mm in a front-to-rear direction. While the above examples may describe particular distances, the apparatus, methods, and articles of manufacture described herein may include a forward portion extending a distance less than 12 mm in a front-to-rear direction. The apparatus, methods, and articles of manufacture described herein are not limited in this regard.

The forward portion 131 may enhance structural integrity of the golf club head 100 and resist rearward deflection of the front portion 170 during impact with a golf ball. The forward portion 131 may transfer an impact force to the crown portion 135 during an impact with a golf ball. The forward portion 131 may distribute an impact force along a surface of the crown portion that abuts a junction 132 formed between the crown portion 135 and the forward portion 131 of the top portion 130. The forward portion 131 may be an integral portion of the body portion 110. In examples where the body portion 110 is formed through a metal (e.g. titanium) casting process, the forward portion 131 may be formed as an integral portion of the body portion during the casting process. The apparatus, methods, and articles of manufacture described herein are not limited in this regard.

The crown portion 135 may be a separate piece that may be attached to the top portion 130. The crown portion 135 may enclose an opening 1201 in the top portion 130. The crown portion 135 may include a heel-side perimeter 1131, a front perimeter 1132, a rear perimeter 1151, and a toe-side perimeter 1133. The apparatus, methods, and articles of manufacture described herein are not limited in this regard.

Figure 12:
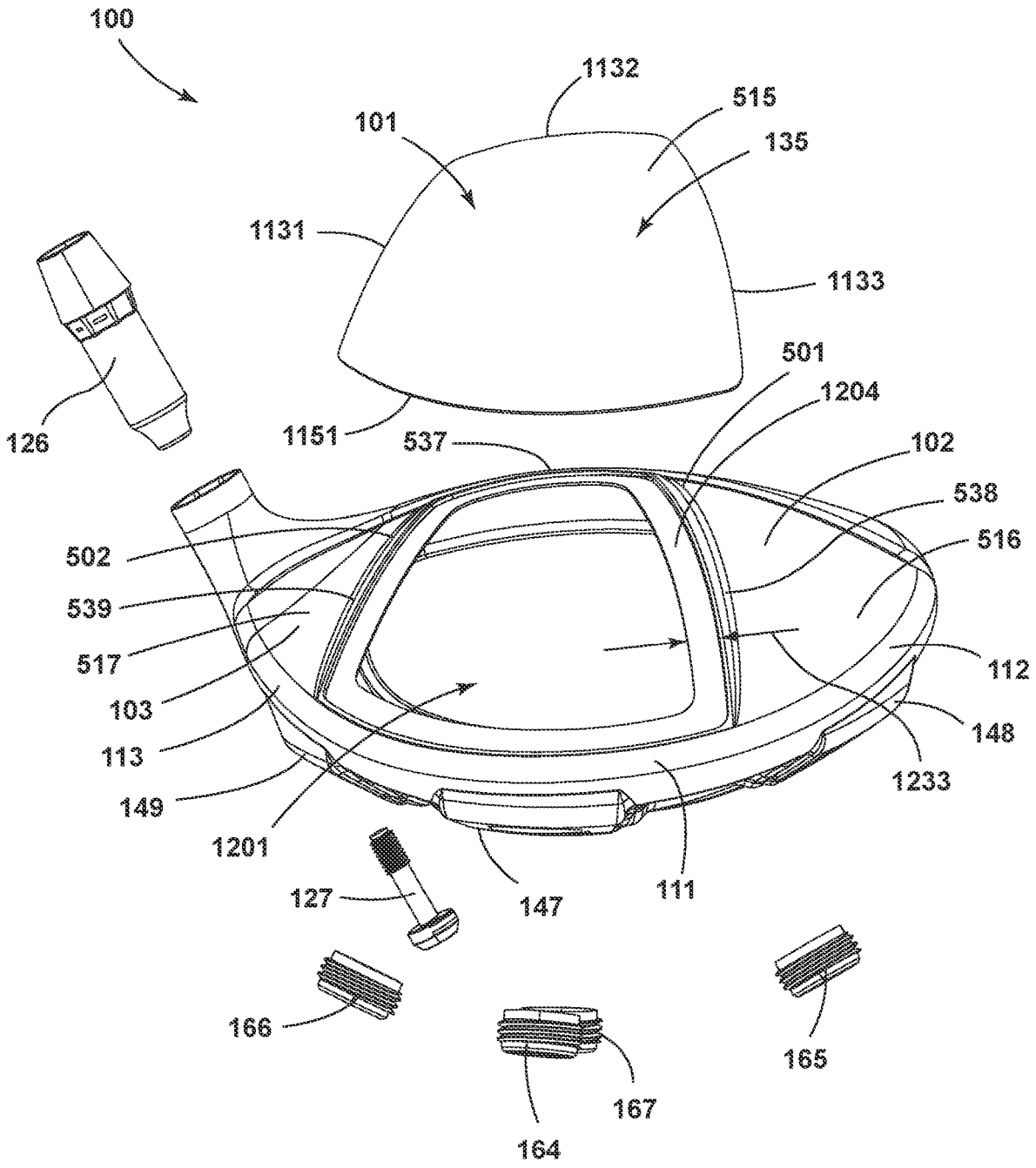
Figure 13:
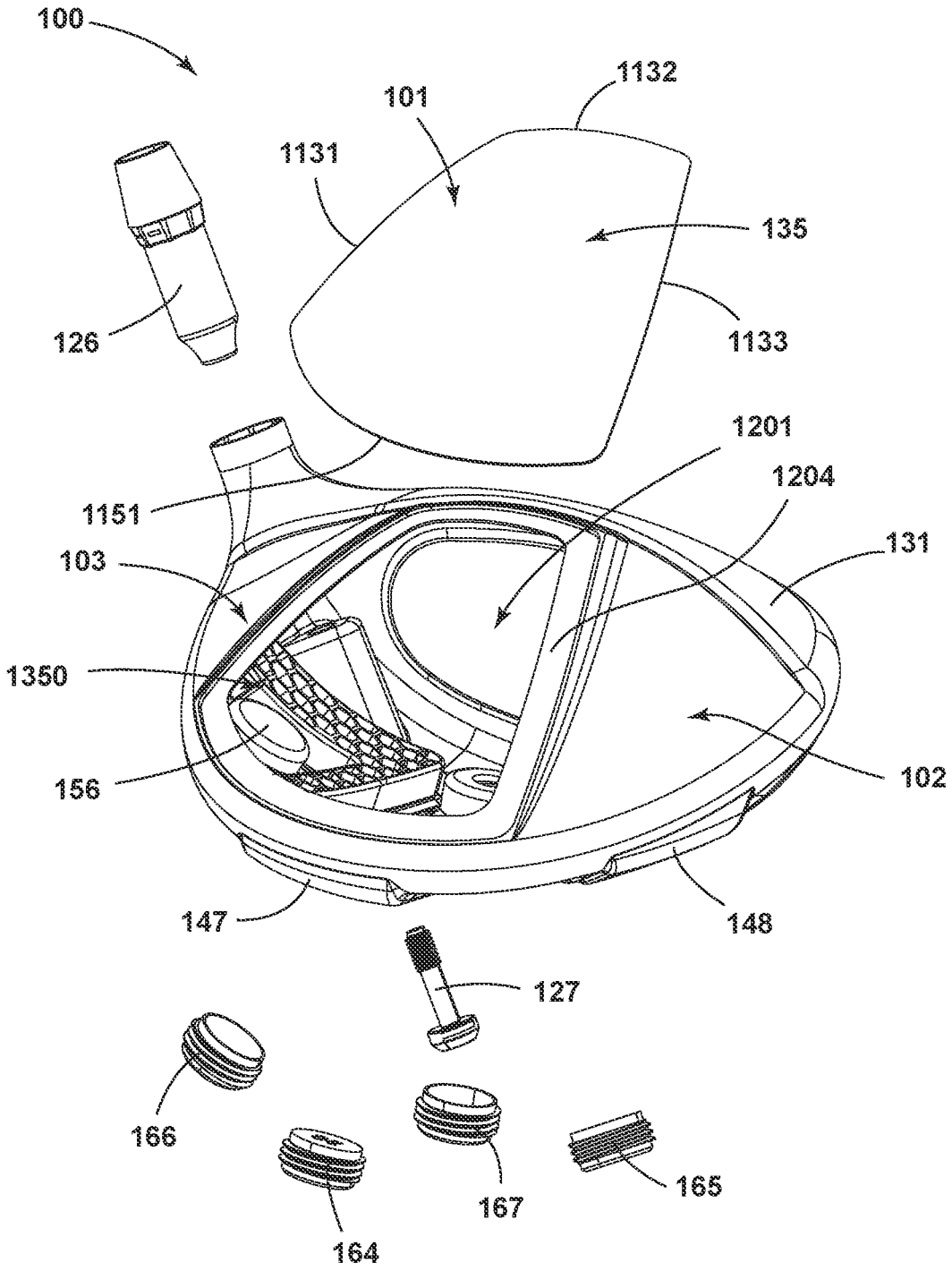

As illustrated in FIGS. 12 and 13, for example, the top portion 130 of the golf club head 100 may include an opening 1201 prior to installation of the crown portion 135. The crown portion 135 may be constructed from one or more materials, and those materials may be the same or different from the material of the body portion 110. In one example, the crown portion 135 may be at least partially constructed from a composite material such as a fiber-based composite material. The crown portion 135 may be attached to a shoulder portion 1204 of the top portion 130. The shoulder portion 1204 may extend along an entire perimeter of the opening 1201 in the top portion 130 or a portion of the opening in the top portion 130. The shoulder portion 1204 may support the crown portion 135. The shoulder portion 1204 may provide a surface suitable for joining (e.g. adhering) the crown portion 135 to the top portion. In one example, the shoulder portion 1204 may extend a distance 1233 of at least 2 mm inward toward the opening 1201 in the top portion 130. In another example, the shoulder portion 1204 may extend a distance 1233 of at least 6 mm. In yet another example, the shoulder portion 1204 may extend a distance 1233 of at least 8 mm. In still another example, the shoulder portion 1204 may extend a distance 1233 of between and including 2 mm and 8 mm. While the above examples may describe particular distances, the apparatus, methods, and articles of manufacture described herein may include a shoulder portion 1204 that extends a distance 1233 less than 2 mm inward toward the opening in the top portion 130. The shoulder portion 1204 may be a continuous portion encircling the opening 1201 in the top portion 130. Alternately, the shoulder portion 1204 may include one or more discrete shoulder portions arranged to support the crown portion 135. In another example, the shoulder portion 1204 may include a plurality of tabs arranged to support the crown portion 135. In still another example, the shoulder portion 1204 may be omitted, and the crown portion 135 may be adhered to an outer surface of the top portion 130 or to an inner surface of the top portion 130. In yet another example, the shoulder portion 1204 may be omitted, and the crown portion 135 may include a protrusion extending from a bottom surface of the crown portion 135 that provides an interference fit with a perimeter edge of the opening 1201 in the top portion 130. The apparatus, methods, and articles of manufacture described herein are not limited in this regard.

In one example, the crown portion 135 may have a thickness of less than 1.0 mm. In another example, the crown portion 135 may have a thickness of less than 0.75 mm. In yet another example, the crown portion 135 may have a thickness of less than or equal to 0.65 mm. The crown portion 135 may be made of a composite material. While the above examples may describe particular thicknesses, the apparatus, methods, and articles of manufacture described herein may have a thickness greater than or equal to 1.0 mm. The apparatus, methods, and articles of manufacture described herein are not limited in this regard.

In one example, the crown portion 135 may form at least 45% of an exterior surface area of the top portion 130. In another example, the crown portion 135 may form at least 55% of an exterior surface area of the top portion 130. In yet another example, the crown portion 135 may form at least 65% of an exterior surface area of the top portion 130. While the above examples may describe particular percentages, the crown portion 135 may form less than 45% of the exterior surface area of the top portion 130. The apparatus, methods, and articles of manufacture described herein are not limited in this regard.

A top stiffening portion 136 may enhance stiffness of the top portion 130. The top stiffening portion 136 may compensate for the presence of one or more relatively less stiff, thin, or lightweight regions elsewhere in the top portion 130 or crown portion 135. The top stiffening portion 136 may enhance overall stiffness of the golf club head 100. The top stiffening portion 136 may limit rearward deflection of the face portion 275 and/or forward portion 131 toward the rear portion 180 in response to the face portion 275 impacting a golf ball. The top stiffening portion 136 may resist physical compression of the crown portion 135 in a front-to-rear direction in response to the face portion 275 impacting a golf ball, which may reduce risk of cracking or delaminating of the crown portion 135 in examples where the crown portion 135 is constructed of two or more layers of composite material. The top stiffening portion 136 may be a raised portion of the top portion 130. The top stiffening portion 136 may be part of a contoured portion of the top portion 130. The top stiffening portion 136 may serve as a visual alignment aid for a golfer aligning a golf shot. The top stiffening portion 136 may improve acoustic response of the golf club head 100 in response to the face portion 275 impacting a golf ball. The top stiffening portion 136 may have a thickness greater than another region of the top portion 130 or the crown portion 135. The top stiffening portion 136 may have a thickness greater than an average thickness of the crown portion 135. The top stiffening portion 136 may be integral to the top portion 130. The top stiffening portion 136 may be one or more separate portions adhered or joined to the top portion 130 to provide structural reinforcement. The apparatus, methods, and articles of manufacture described herein are not limited in this regard.

As mentioned above, the top portion 130 may include one or more top stiffening portions. In one example, the top stiffening portion 136 may include a first top stiffening portion 137, a second top stiffening portion 138, and a third top stiffening portion 139, as shown in FIG. 1. The first top stiffening portion 137 may be located adjacent to the forward portion 131 of the top portion 130. The first top stiffening portion 137 may have a thickness greater than an average thickness of the crown portion 135. In one example, the first top stiffening portion 137 may have a thickness of greater than 2 mm. In another example, the first top stiffening portion 137 may have a thickness of greater than or equal to 2.1 mm. In another example, the first top stiffening portion 137 may have a thickness of greater than or equal to 2.2 mm. In still another example, the first top stiffening portion 137 may have a thickness of greater than or equal to 2.4 mm. While the above examples may describe particular thickness, the apparatus, methods, and articles of manufacture described herein may include the first top stiffening portion 137 with a thickness of less than or equal to 2 mm. In one example, the first top stiffening portion 137 may have a length of at least 1.25 cm in a heel-to-toe direction. In another example, the first top stiffening portion 137 may have a length of at least 2 cm in a heel-to-toe direction. In yet another example, the first top stiffening portion 137 may have a length of at least 3 cm in a heel-to-toe direction. In still yet another example, the first top stiffening portion 137 may have a length of at least 4 cm in a heel-to-toe direction. In another example, the first top stiffening portion 137 may have a length of between and including 4 and 4.5 cm in a heel-to-toe direction. While the above examples may describe particular lengths, the apparatus, methods, and articles of manufacture describe herein may include the first top stiffening portion 137 having a length of less than 3 cm. The first top stiffening portion 137 may reduce aerodynamic drag of the golf club head 100. The apparatus, methods, and articles of manufacture described herein are not limited in this regard.

The second top stiffening portion 138 may extend from the first top stiffening portion 137 toward the rear portion 180. The second top stiffening portion 138 may extend from the first top stiffening portion 137 toward the rear portion 180 and toward the toe portion 150. The second top stiffening portion 138 may extend from a toe-side end of the first top stiffening portion 137 to a rear perimeter of the crown portion 135. The second top stiffening portion 138 may extend from the first top stiffening portion 137 toward a weight port region on the sole portion 140. The second top stiffening portion 138 may extend from the first top stiffening portion 137 toward a weight port region on the sole portion 140, where the weight port region is closer to the toe portion 150 than other weight port regions on the bottom portion. The second top stiffening portion 138 may taper in width in a front-to-rear direction. The apparatus, methods, and articles of manufacture described herein are not limited in this regard.

The second top stiffening portion 138 may serve as a support structure between the forward portion 131 and the rear portion 180. The second top stiffening portion 138 may oppose rearward deflection of the forward portion 131 in response to the face portion 275 impacting a golf ball. The second top stiffening portion 138 may have a thickness greater than an average thickness of the crown portion 135. The second top stiffening portion 138 may have a thickness of greater than 2 mm. The second top stiffening portion 138 may have a thickness of greater than or equal to 2.1 mm. The second top stiffening portion 138 may have a thickness of greater than or equal to 2.2 mm. While the above examples may describe particular thicknesses, the apparatus, methods, and articles of manufacture described herein may include the second top stiffening portion 138 with a thickness of less than or equal to 2 mm. In one example, the second top stiffening portion 138 may have a length of at least 2 cm. In another example, the second top stiffening portion 138 may have a length of at least 4 cm. While the above examples may describe particular lengths, the apparatus, methods, and articles of manufacture describe herein may include a second top stiffening portion 138 having a length less than 2 cm. The second top stiffening portion 138 may reduce aerodynamic drag of the golf club head. The apparatus, methods, and articles of manufacture described herein are not limited in this regard.

The third top stiffening portion 139 may extend from the first top stiffening portion 137 toward the rear portion 180. The third top stiffening portion 139 may extend from the first top stiffening portion 137 toward the rear portion 180 and toward the heel portion 160. The third top stiffening portion 139 may extend from a heel-side end of the first top stiffening portion 137 to a rear perimeter of the crown portion 135. The third top stiffening portion 139 may extend from the first top stiffening portion 137 toward a weight port region on the sole portion 140. The third top stiffening portion 139 may extend from the first top stiffening portion 137 toward a weight port region on the sole portion 140, where the weight port region is closer to the heel portion 160 than other weight port regions on the bottom portion. The third top stiffening portion 139 may taper in width in a front-to-rear direction. The apparatus, methods, and articles of manufacture described herein are not limited in this regard.

The third top stiffening portion 139 may serve as a support structure between the forward portion 131 and the rear portion 180. The third top stiffening portion 139 may oppose rearward deflection of the forward portion 131 in response to the face portion 275 impacting a golf ball. The third top stiffening portion 139 may have a thickness greater than an average thickness of the crown portion 135. The third top stiffening portion 139 may have a thickness of greater than 2 mm. The third top stiffening portion 139 may have a thickness of greater than or equal to 2.1 mm. The third top stiffening portion 139 may have a thickness of greater than or equal to 2.2 mm. While the above examples may describe particular thicknesses, the apparatus, methods, and articles of manufacture described herein may include the third top stiffening portion 139 with a thickness of less than or equal to 2 mm. The third top stiffening portion 139 may have a length of at least 2 cm. The third top stiffening portion 139 may have a length of at least 4 cm. The third top stiffening portion 139 may reduce aerodynamic drag of the golf club head. While the above example may describe a particular number of top stiffening portions, the apparatus, methods, and articles of manufacture described herein may include more or fewer top stiffening portions. The apparatus, methods, and articles of manufacture described herein are not limited in this regard.

Figure 7:
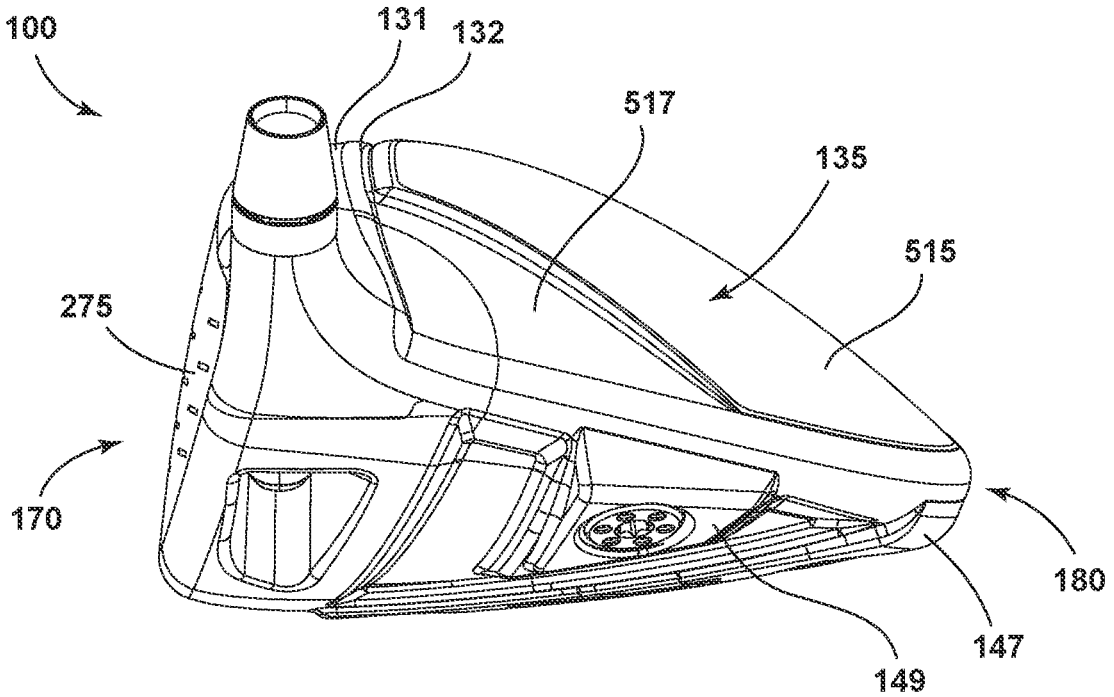

The top portion 130 may include a central top portion 101, a toe-side top portion 102, and a heel-side top portion 103. The central top portion 101 may be a raised central top portion 101. The raised central top portion 101 may be located between the heel-side top portion 103 and the toe-side top portion 102. The raised central top portion 101 may have a maximum height greater than a maximum height of the toe-side top portion 102, as shown in FIG. 8. The raised central top portion 101 may have a maximum height greater than a maximum height of the heel-side top portion 103, as shown in FIG. 7. The raised central top portion 101 may serve as a visual alignment aid. The raised central top portion 101 may improve aerodynamic performance of the golf club head 100. The raised central top portion 101 may stiffen the top portion 130 and reduce deflection (e.g. bulging) of the top portion 130 in response to the face portion 275 impacting a golf ball. Reducing bulging of the top portion 130 may be desirable to reduce shear stress on a joint (e.g. an adhesive bond) between the crown portion 135 and the shoulder portion 1204 of the opening 1201 in the top portion 130. The apparatus, methods, and articles of manufacture described herein are not limited in this regard.

The central top portion 101 may include a thin portion. The toe-side top portion 102 may include a thin portion. The heel-side top portion 103 may include a thin portion. Thin portions may be desirable to reduce overall mass of the top portion 130, which may lower the CG of the golf club head 100. The apparatus, methods, and articles of manufacture described herein are not limited in this regard.

The top portion 130 may include a plurality of contoured surfaces. The plurality of contoured surfaces may generate turbulent flow across the top portion 130 of the golf club head 100 during a golf swing. The plurality of contoured surfaces may reduce aerodynamic drag of the golf club head 100. The plurality of contoured surfaces may enhance rigidity of the golf club head 100. The plurality of contoured surfaces may enhance structural integrity of the golf club head 100. The apparatus, methods, and articles of manufacture described herein are not limited in this regard An area of the outer surface 515 of the central top portion 101 may be elevated above an outer surface 516 of the toe-side top portion 102. The outer surface 515 area of the central top portion 101 may be elevated above an outer surface 517 of the heel-side top portion 103. The apparatus, methods, and articles of manufacture described herein are not limited in this regard. The apparatus, methods, and articles of manufacture described herein are not limited in this regard The top portion 130 may include a first contoured transition region 501 located between the central top portion 101 and the toe-side top portion 102. The crown portion 135 may include a second contoured transition region 502 located between the central top portion 101 and the heel-side top portion 103. The location of the first contoured transition region 501 may coincide with the location of the second top stiffening portion 138. The location of the second contoured transition region 502 may coincide with the location of the third top stiffening portion 139. Together, the central top portion 101, toe-side top portion 102, heel-side top portion 103, first contoured transition region 501, and second contoured transition region 502 may form a multi-level top portion 130. Together, the central top portion 101, toe-side top portion 102, heel-side top portion 103, first contoured transition region 501, and second contoured transition region 502 may form a multi-thickness top portion 130. The apparatus, methods, and articles of manufacture described herein are not limited in this regard.

Figure 5:
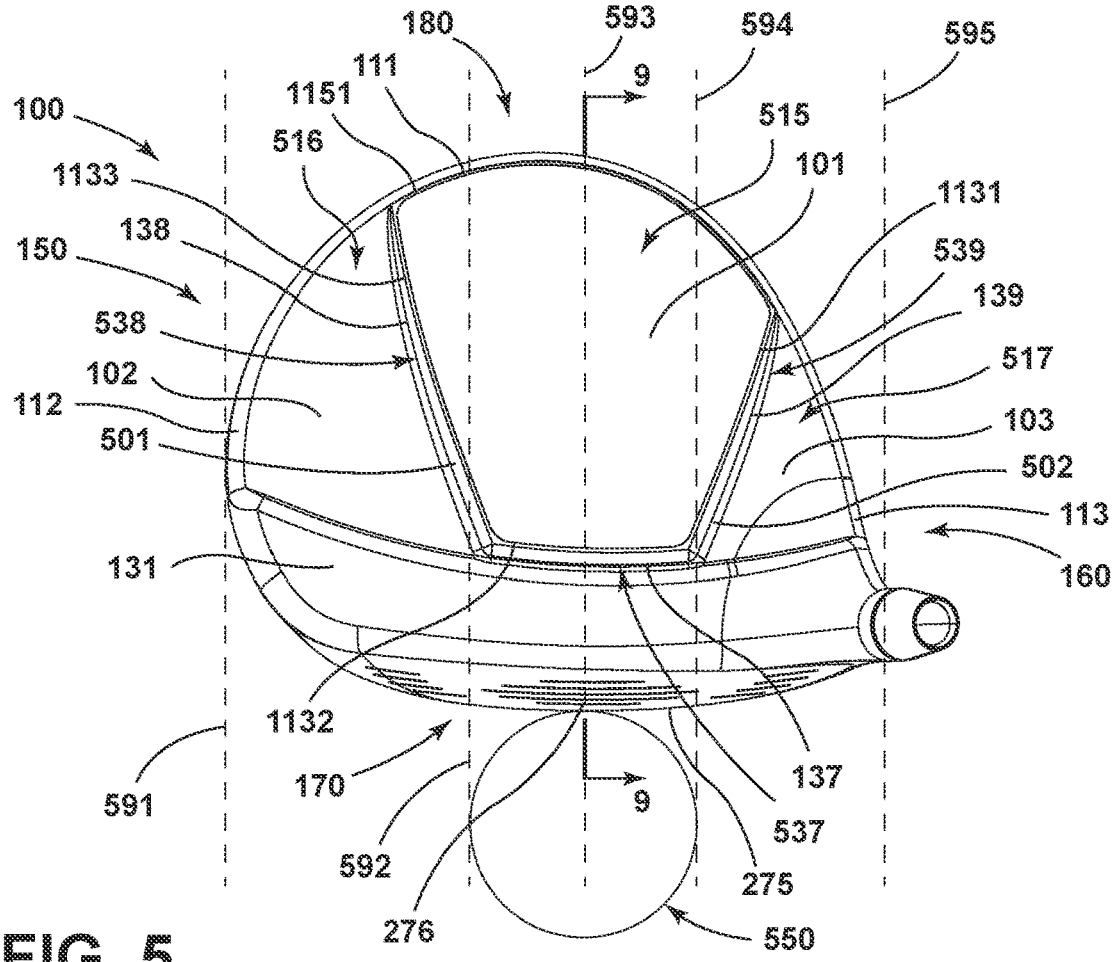
Figure 9:
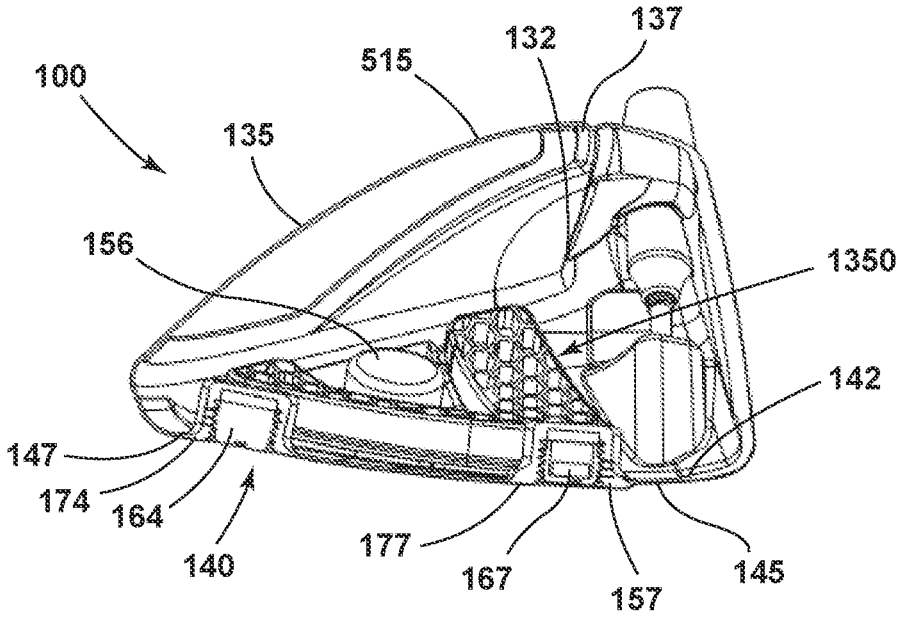

FIG. 9 depicts a cross-sectional toe side view of the example golf club head of FIG. 1 taken at section line 9-9 of FIG. 5. The outer surface 515 of the central top portion 101 may be elevated above an outer surface 517 of the heel-side top portion 103. In one example, the outer surface 515 of the central top portion 101 may be elevated above an outer surface 517 of the heel-side top portion 103 by a height of greater than or equal to 0.5 mm. In another example, the outer surface 515 of the central top portion 101 may be elevated above an outer surface 517 of the heel-side top portion 103 by a height of greater than or equal to 1.0 mm. In yet another example, the outer surface 515 of the central top portion 101 may be elevated above an outer surface 517 of the heel-side top portion 103 by a height of greater than or equal to 2.0 mm. The apparatus, methods, and articles of manufacture described herein are not limited in this regard.

The outer surface 515 of the central top portion 101 may be elevated above an outer surface 516 of the toe-side top portion 102. In one example, the outer surface 515 of the central top portion 101 may be elevated above an outer surface 516 of the toe-side top portion 102 by a height of greater than or equal to 0.5 mm. In another example, the outer surface 515 of the central top portion 101 may be elevated above an outer surface 516 of the toe-side top portion 102 by a height of greater than or equal to 1.0 mm. In yet another example, the outer surface 515 of the central top portion 101 may be elevated above an outer surface 516 of the toe-side top portion 102 by a height of greater than or equal to 2.0 mm. While the above examples may describe particular heights, the apparatus, methods, and articles of manufacture described herein may include outer surfaces with a difference in height of less than 0.5 mm. The apparatus, methods, and articles of manufacture described herein are not limited in this regard.

As shown in FIG. 7, the outer surface 517 of the heel-side top portion 103 may be recessed below the forward portion 131 proximate to the junction 132. Likewise, as shown in FIG. 8, the outer surface 516 of the toe-side top portion 102 may be recessed below the forward portion 131 proximate the junction 132. In one example, the outer surface 517 of the heel-side top portion 103 may be recessed below the forward portion 131 proximate to the junction 132 by a distance of greater than or equal to 0.5 mm. In another example, the outer surface 517 of the heel-side top portion 103 may be recessed below the forward portion 131 proximate to the junction 132 by a distance of greater than or equal to 1.0 mm. In yet another example, the outer surface 516 of the toe-side top portion 102 may be recessed below the forward portion 131 proximate the junction 132 by a distance of greater than or equal to 0.5 mm. The outer surface 516 of the toe-side top portion 102 may be recessed below the forward portion 131 proximate the junction 132 by a distance of greater than or equal to 1.0 mm. While the above examples may describe particular distances, the apparatus, methods, and articles of manufacture described herein may include outer surfaces recessed by distances of less than 0.5 mm. The apparatus, methods, and articles of manufacture described herein are not limited in this regard.

The central top portion 101 may be bounded by the first contoured transition region 501, the second contoured transition region 502, a rear perimeter 1151, and a front perimeter 1132, as shown in FIGS. 5 and 12. The central top portion 101 may be bounded by the first contoured transition region 501, the second contoured transition region 502, a rear body perimeter 111, and a front perimeter 1132, as shown in FIG. 5. The central top portion 101 may be bounded by the first top stiffening portion 137, the second top stiffening portion 138, the third top stiffening portion 139, and the rear perimeter 1151, as shown in FIG. 5. The apparatus, methods, and articles of manufacture described herein are not limited in this regard.

A front region of the central top portion 101 may have a symmetrical shape relative to a central vertical plane 593 that intersects the geometric center (e.g., at or proximate to a "sweet spot" of the golf club head 100) on the face portion 275 and is normal to a front vertical plane. A front portion of the central top portion 101 may have a nonsymmetrical shape relative to the central vertical plane 593 that intersects the geometric center on the face portion 275 and is normal to the front vertical plane. The apparatus, methods, and articles of manufacture described herein are not limited in this regard.

In one example, the second top stiffening portion 138 and third top stiffening portion 139 may diverge in a front-to-rear direction, as shown in FIG. 5. The central top portion 101 may have an irregular polygon-like shape (e.g., a quadrilateral-like shape). The distance between the second and third top stiffening portions 138 and 139 at or proximate to the front portion 170 may be less than the distance between the second and third top stiffening portions 138 and 139 at or proximate to the rear portion 180. In another example, the second top stiffening portion 138 and third top stiffening portion 139 may converge in a front-to-rear direction. A distance between the second and third top stiffening portions 138 and 139 at or proximate to the front portion 170 may be greater than a distance between the second and third top stiffening portions 138 and 139 at or proximate to the rear portion 180. In yet another example, the second top stiffening portion 138 and third top stiffening portion 139 may converge and then diverge in a front-to-rear direction. In another example, the second top stiffening portion 138 and third top stiffening portion 139 may diverge and then converge in a front-to-rear direction. In still another example, the second top stiffening portion 138 and third top stiffening portion 139 may be substantially parallel in a front-to-rear direction. The distance between the second stiffening portion 138 and third top stiffening portion 139 at or proximate to the front portion 170 may be equal or substantially the same as the distance between the second and third top stiffening portions 138 and 139 at or proximate to the rear portion 180. The apparatus, methods, and articles of manufacture described herein are not limited in this regard.

In one example, as shown in FIG. 1, the central top portion 101 may be raised relative to the toe-side top portion 102 and the heel-side top portion 103, resulting in a raised central top portion 101. Variations in relative heights of the central top portion 101, toe-side top portion 102, and heel-side top portion 103 may improve aerodynamic performance by reducing a drag coefficient associated with the golf club head 100. Variations in relative heights of the central top portion 101, toe-side top portion 102, and heel-side top portion 103 may provide a visual alignment aid. Variations in relative heights of the central top portion 101, toe-side top portion 102, and heel-side top portion 103, together with contoured transition regions (501, 502) with integral ribs, may enhance structural integrity of the top portion 130. In another example, the central top portion 101 may be depressed relative to the toe-side top portion 102 and the heel-side top portion 103. The apparatus, methods, and articles of manufacture described herein are not limited in this regard.

The total surface area of the top portion 130 may include surface areas of the central top portion 101, toe-side top portion 102, heel-side top portion 103, first contoured transition region 501, second contoured transition region 502, and the forward portion 131. In one example, the surface area of the central top portion 101 may be less than or equal to 40% of the total surface area of the top portion 130. In another example, the surface area of the central top portion 101 may be at least 10% of the total surface area of the top portion 130. In another example, the surface area of the central top portion 101 may be at least 20% of the total surface area of the top portion 130. In yet another example, the surface area of the central top portion 101 may be at least 30% of the total surface area of the top portion 130. In still yet another example, the surface area of the central top portion 101 may be at least 40% of the total surface area of the top portion 130. In still yet another example, the surface area of the central top portion 101 may be at least 50% of the surface area of the top portion 130. In another example, the surface area of the central top portion 101 may be at least 60% of the total surface area of the top portion 130. In still yet another example, the surface area of the central top portion 101 may be at least 70% of the total surface area of the top portion 130. In still yet another example, the surface area of the central top portion 101 may be at least 80% of the total surface area of the top portion 130. In still yet another example, the surface area of the central top portion 101 may be at least 90% of the total surface area of the top portion 130. The apparatus, methods, and articles of manufacture described herein are not limited in this regard.

The toe-side top portion 102 may be bounded by the first contoured transition region 501, a toe-side body perimeter 112, and the forward portion 131. In one example, the surface area of the toe-side top portion 102 may be at least 5% of the total surface area of the top portion 130. In another example, the surface area of the toe-side top portion 102 may be at least 10% of the total surface area of the crown portion 135. In yet another example, the surface area of the toe-side top portion 102 may be at least 15% of the total surface area of the top portion 130. In still yet another example, the surface area of the toe-side top portion 102 may be at least 20% of the surface area of the top portion 130. In still yet another example, the surface area of the toe-side top portion 102 may be at least 25% of the total surface area of the top portion 130. In still yet another example, the surface area of the toe-side top portion 102 may be at least 30% of the total surface area of the top portion 130. In still yet another example, the surface area of the toe-side top portion 102 may be at least 35% of the total surface area of the top portion 130. In still yet another example, the surface area of the toe-side top portion 102 may be at least 40% of the total surface area of the top portion 130. The apparatus, methods, and articles of manufacture described herein are not limited in this regard.

The heel-side top portion 103 may be bounded by the second contoured transition region 502, a heel-side body perimeter 113, and the forward portion 131. In one example, the surface area of the heel-side top portion 103 may be at least 5% of the total surface area of the top portion 130. In another example, the surface area of the heel-side top portion 103 may be at least 10% of the total surface area of the top portion 130. In yet another example, the surface area of the heel-side top portion 103 may be at least 15% of the total surface area of the top portion 130. In still yet another example, the surface area of the heel-side top portion 103 may be at least 20% of the total surface area of the top portion 130. In still yet another example, the surface area of the heel-side top portion 103 may be at least 25% of the total surface area of the top portion 130. In still yet another example, the surface area of the heel-side top portion 103 may be at least 30% of the total surface area of the top portion 130. The apparatus, methods, and articles of manufacture described herein are not limited in this regard.

In one example, the area of the outer surface 515 of the central top portion 101 may be greater than or equal to 40% of a total outer surface area of the top portion 130, the outer surface 516 area of the toe-side top portion 102 may be less than or equal to 30% of the total outer surface area of the top portion 130, and the outer surface 517 area of the heel-side top portion 103 be less than or equal to 15% of the total outer surface area of the top portion 130. In another example, the area of the outer surface 515 of the central top portion 101 may be greater than or equal to 50% of a total outer surface area of the top portion 130, the outer surface area of the toe-side top portion 102 may be greater than or equal to 15% of the total outer surface area of the top portion 130, and the outer surface area of the heel-side top portion 103 be greater than or equal to 5% of the total outer surface area of the top portion 130. In another example, the area of the outer surface 515 of the central top portion 101 may be greater than or equal to 30% of a total outer surface area of the top portion 130, the outer surface area of the toe-side top portion 102 may be greater than or equal to 10% of the total outer surface area of the top portion 130, and the outer surface area of the heel-side top portion 103 be greater than or equal to 5% of the total outer surface area of the top portion 130. The apparatus, methods, and articles of manufacture described herein are not limited in this regard.

FIG. 5 depicts a top view of the example golf club head 100 of FIG. 1 with a golf ball 550 proximate to the face portion 275. The golf ball 550 may be in contact with and aligned with a geometric center 276 of the face portion 275. The golf ball 550 may have a diameter of about 1.68 inches. A central vertical plane 593 bisects the golf ball 550 and the golf club head 100. A toe-side bounding plane 591 bounds a toe-side of the golf club head 100. A heel-side bounding plane 595 bounds a heel-side of the golf club head 100. A toe-side dividing plane 592 divides the toe-side of the golf club head and bounds a toe-side of the golf ball 550. A heel-side dividing plane 594 divides the heel-side of the golf club head and bounds a heel-side of the golf ball 550. The top portion 130 may include a perimeter that includes a toe-side perimeter, heel-side perimeter, front perimeter, and rear perimeter. The apparatus, methods, and articles of manufacture described herein are not limited in this regard.

The top portion 130 of the golf club head 100 may include a plurality of integral ribs. The integral ribs may form the top stiffening portion 136. The integral ribs (e.g., generally shown as 537, 538, and 539) may provide embedded structural supports within the top portion 130. Each integral rib may be located in a top stiffening region adjacent to one or more thin portions. The top portion 130 may have contoured transition regions (e.g., generally shown as 501 and 502) between the thin portions and the thicker top stiffening portions where the integral ribs reside. Contoured transition regions may prevent or mitigate unwanted stress concentrations within the top portion 130 by avoiding distinct edges between thin portions and adjacent thicker portions (e.g., such as 137, 138, or 139). Stress concentrations may be undesirable as they may result in cracking or delaminating of layers of the top portion 130 during use of the golf club head 100. For example, in an alternative embodiment having non-integral ribs attached to either an inner or outer surface of the top portion 130, a distinct edge may exist at a junction formed between a non-integral rib and a surface of the top portion 130, and that edge may introduce an unwanted stress concentration. After numerous ball strikes, presence of the stress concentration may result in cracking of the top portion 130 proximate to the non-integral rib. This physical deterioration of the top portion 130 may negatively impact performance of the golf club head 100. For instance, as the top portion 130 physically deteriorates, shot-to-shot variability may increase. Shot-to-shot variability may be unacceptable to an individual who requires consistent performance from the golf club head 100. Physical deterioration of the top portion 130 may also negatively affect appearance of the golf club head 100. For the sake of long-term durability, consistency, and appearance, it is therefore desirable to have a top portion 130 with contoured transition regions (501, 502) between the thin portions and the thicker portions containing integral ribs. The apparatus, methods, and articles of manufacture described herein are not limited in this regard.

The top portion 130 may include a toe-side integral rib 538. The toe-side integral rib 538 may extend from the front perimeter 1132 of the crown portion 135 to the rear perimeter 1151 of the crown portion. The toe-side integral rib 538 may extend rearward from the forward portion 131. The toe-side integral rib 538 may extend rearward from a starting location between the central vertical plane 593 and the toe-side dividing plane 592 and terminate at an ending location between the toe-side bounding plane 591 and the toe-side dividing plane 592. The apparatus, methods, and articles of manufacture described herein are not limited in this regard.

In one example, the toe-side integral rib 538 may have a maximum thickness between and including 1.0 mm and 2.0 mm. In another example, the toe-side integral rib 538 may have a maximum thickness greater than or equal to 1.0 mm. In another example, the toe-side integral rib 538 may have a maximum thickness greater than or equal to 2.0 mm. In another example, the toe-side integral rib 538 may have a maximum thickness greater than or equal to 2.1 mm. In yet another example, the toe-side integral rib 538 may have a maximum thickness greater than or equal to 2.2 mm. In yet another example, the toe-side integral rib 538 may have a maximum thickness greater than or equal to 2.4 mm. While the above examples may describe particular thicknesses, the apparatus, methods, and article of manufacture described herein may include the toe-side integral rib 538 with a maximum thickness of less than 2 mm. The apparatus, methods, and articles of manufacture described herein are not limited in this regard.

The top portion 130 may include a heel-side integral rib 539. The heel-side integral rib 539 may extend from a front perimeter 1132 of the crown portion 135 to a rear perimeter 1151 of the crown portion. The heel-side integral rib 539 may extend rearward from the forward portion 131. The heel-side integral rib 539 may extend rearward from a starting location between the central vertical plane 593 and the heel-side dividing plane 594 and terminate at an ending location between the heel-side bounding plane 595 and the heel-side dividing plane 594. The apparatus, methods, and articles of manufacture described herein are not limited in this regard.

In one example, the heel-side integral rib 539 may have a maximum thickness between and including 1.0 mm and 2.0 mm. In another example, the heel-side integral rib 539 may have a maximum thickness greater than or equal to 1.0 mm. In another example, the heel-side integral rib 539 may have a maximum thickness greater than or equal to 2.0 mm. In another example, the heel-side integral rib 539 may have a maximum thickness greater than or equal to 2.1 mm. In yet another example, the heel-side integral rib 539 may have a maximum thickness greater than or equal to 2.4 mm. While the above examples may describe particular thicknesses, the apparatus, methods, and article of manufacture described herein may include the heel-side integral rib 539 with a maximum thickness of less than 2 mm. The apparatus, methods, and articles of manufacture described herein are not limited in this regard.

The top portion 130 may include a central integral rib 537. The central integral rib 537 may extend along the front perimeter 1132 of the crown portion 135. The central integral rib 537 may extend from the toe-side integral rib 538 to the heel-side integral rib 539. The central integral rib 537 may extend from a forward-most end of the toe-side integral rib 538 to a forward-most end of the heel-side integral rib 539. The central integral rib 537 may extend a distance of at least 3 centimeters beside the junction 132 formed between the front perimeter 1132 of the crown portion 135 and the forward portion 131 of the top portion 130. The central integral rib 537 may be located between the toe-side dividing plane 592 and the heel-side dividing plane 594. The central integral rib 537 and the face portion 275 may have parallel curves. In one example, the central integral rib 537 may have a maximum thickness greater than or equal to 2.0 mm. In another example, the central integral rib 537 may have a maximum thickness greater than or equal to 2.1 mm. In yet another example, the central integral rib 537 may have a maximum thickness greater than or equal to 2.4 mm. While the above examples may describe particular thicknesses, the apparatus, methods, and article of manufacture described herein may include the central integral rib 537 with a maximum thickness of less than 2 mm. The apparatus, methods, and articles of manufacture described herein are not limited in this regard.

The integral ribs (e.g., generally shown as 537, 538, and 539) may enhance the flexural strength of the top portion 130. The integral ribs may enhance the compressive strength of the top portion 130. The integral ribs may reduce outward deflection (e.g., bulging) of the top portion 130 in response to an impact force transferred from the body portion 110 to the crown portion 135 during impact with a golf ball. The integral ribs may reduce deflection of the crown portion 135 inward toward in the interior cavity of the golf club head 100 in response to a downward force applied to an outer surface of the crown portion 135. Inward deflection of the crown portion 135 may be easier to accurately measure in a test environment than outward deflection. In certain instances, resistance to inward deflection may correlate to resistance to outward deflection. Inward deflection may be measured by applying a downward force to an outer surface of the crown portion and measuring physical deflection of the crown portion with a suitable measuring device. In one example, when a downward force of 200 pound-force (lbf) is applied to the central top portion 101, the central top portion 101 may deflect less than 0.025 inch. In another example, when a downward force of 200 lbf is applied to the central top portion 101, the central top portion 101 may deflect less than 0.015 inch. In another example, when a downward force of 200 lbf is applied to the central top portion 101, the central top portion 101 may deflect less than 0.012 inch. The apparatus, methods, and articles of manufacture described herein are not limited in this regard.

Certain rules or regulations imposed by the USGA or other governing bodies may limit a spring-like effect of certain designs, materials, or constructions of golf club heads. To ensure a club head 100 conforms to certain rules and regulations, it may therefore be desirable to minimize spring-like effects of certain aspects of the club head. For instance, it may be desirable to minimize a spring-like effect of the top portion 130 by reinforcing the crown portion to minimize deflection during use. The integral ribs may allow the top portion 130 to resist deflection better than a similar lightweight crown portion that lacks integral ribs. In one example, the top portion 130 with integral ribs may only deflect inward about 0.012 inch whereas a crown portion without integral ribs may deflect about 0.020 inch in response to applying a downward force of 200 lbf to the respective crown portions. The apparatus, methods, and articles of manufacture described herein are not limited in this regard.

As shown in FIG. 5, the toe-side integral rib 538 and the heel-side integral rib 539 may diverge in a front-to-rear direction along the top portion 130. In another example, the toe-side integral rib 538 and heel-side integral rib 539 may converge in a front-to-rear direction along the top portion 130. In yet another example, a toe-side integral rib 538 and a heel-side integral rib 539 may converge and then diverge in a front-to-rear direction along the top portion 130. In another example, the toe-side integral rib 538 and heel-side integral rib 539 may be substantially parallel in a front-to-rear direction along the top portion 130. The toe-side rib 538 may include one or more curved portions along its length. Similarly, the heel-side rib 539 may include one or more curved portions along its length. The apparatus, methods, and articles of manufacture described herein are not limited in this regard.

An outer surface of the top portion 130 may have an anti-glare finish. An outer surface of the top portion 130 may have a medium or low gloss appearance to reduce the amount of light reflected upward at an individual's eyes when aligning the golf club head 100 with a golf ball and performing a golf shot. A relative gloss value may be determined by projecting a beam of light at a fixed intensity and angle onto the outer surface of the top portion 130 and measuring the amount of light reflected at an equal but opposite angle upward at the individual. On a measurement scale, a specular reflectance of 0 gloss units (GU) may be associated with a perfectly matte surface, and a specular reflectance of 100 GU may be associated with a highly polished black glass material. Providing a top portion 130 with a relatively low specular reflectance may be desirable to reduce distraction perceived by the individual of the golf club head 100, which may reduce mishits and thereby improve performance. In one example, an outer surface of the top portion 130 may have a specular reflectance of less than 55 GU. In another example, the outer surface of the top portion 130 may have a specular reflectance of less than 40 GU. In yet another example, the outer surface of the top portion 130 may have a specular reflectance of less than 25 GU. In still another example, the outer surface of the top portion 130 may have a specular reflectance of less than 10 GU. While the above examples may describe particular specular reflectance, the apparatus, methods, and article of manufacture may include the outer surface of the top portion 130 with a specular reflectance greater than or equal to 55 GU. The apparatus, methods, and articles of manufacture described herein are not limited in this regard.

In some examples, the outer surface of the top portion 130 may include an antireflective coating 133. In one example, the antireflective coating 133 may have a specular reflectance of less than 55 GU. In another example, the antireflective coating 133 may have a specular reflectance of less than 40 GU. In yet another example, the antireflective coating 133 may have a specular reflectance of less than 25 GU. In still another example, the antireflective coating 133 may have a specular reflectance of less than 10 GU. The apparatus, methods, and articles of manufacture described herein are not limited in this regard.

Figure 6:
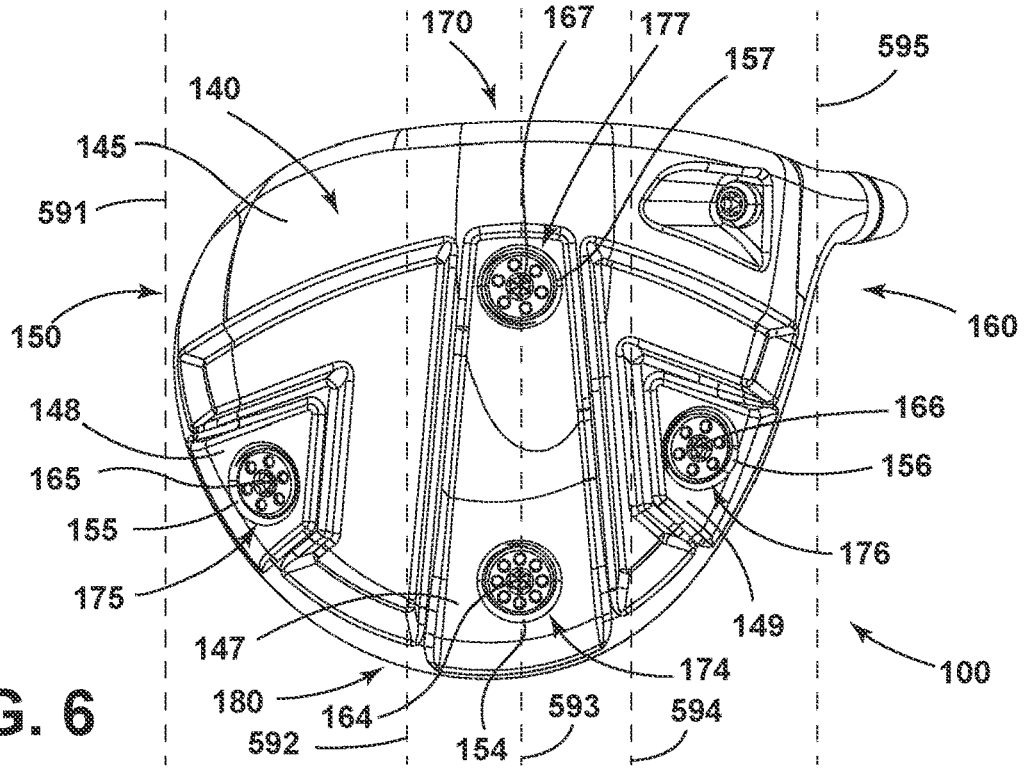

The golf club head 100 may include a plurality of weigh port regions. Each weight port region may include a weight port. Each weight port may include a weight. As shown in FIG. 6, a first weight port region 174 may be located closer to the rear portion 180 than the front portion 170. A second weight port region 175 may be located closer to the toe portion 150 than the heel portion 160. A third weight port region 176 may be located closer to the heel portion 160 than the toe portion 150. A fourth weight port region 177 may be located closer to the front portion 170 than the rear portion 180. The apparatus, methods, and articles of manufacture described herein are not limited in this regard.

The first weight port region 174 may include a first weight port 154 containing a first weight portion 164. The second weight port region 175 may include a second weight port 155 containing a second weight portion 165. The third weight port region 176 may include a third weight port 156 containing a third weight portion 166. The fourth weight port region 177 may include a fourth weight port 157 containing a fourth weight portion 167. The apparatus, methods, and articles of manufacture described herein are not limited in this regard.

The set of weight portions (e.g., generally shown as weight portions 164, 165, 166, and 167) may have similar or different masses. By using weight portions having similar or different masses in each of the weight ports, the overall mass in a weight port region and/or the mass distribution in the weight port regions may be adjusted to generally optimize and/or adjust the swing weight, center of gravity, moment of inertia, and/or an overall feel of the golf club head 100 for an individual using the golf club head 100. In one example, the set of weight portions may collectively have a mass of at least 8 grams. In another example, the set of weight portions may collectively have a mass of at least 12 grams. In yet another example, the set of weight portions may collectively have a mass of between and including 8 grams and 13 grams. In still yet another example, the set of weight portions may collectively have a mass of between and including 12 grams and 16 grams. In still yet another example, the set of weight portions may collectively have a mass of between and including 15 grams and 19 grams. In still yet another example, the set of weight portions may collectively have a mass of between and including 18 grams and 22 grams. While the above examples may describe particular masses, the apparatus, methods, and articles of manufacture described herein may include the set of weight portions to have an aggregate mass of less than 8 grams or an aggregate mass of greater than 19 grams. The apparatus, methods, and articles of manufacture described herein are not limited in this regard.

The sole portion 140 of the golf club head 100 may have in inner surface 142 and an outer surface 145. The golf club head 100 may include one or more raised portions protruding outward from the outer surface 145. Each raised portion may include a weight port region. Each weight port region may include a weight port. Each weight port may include a weight portion. The apparatus, methods, and articles of manufacture described herein are not limited in this regard.

Figure 2:
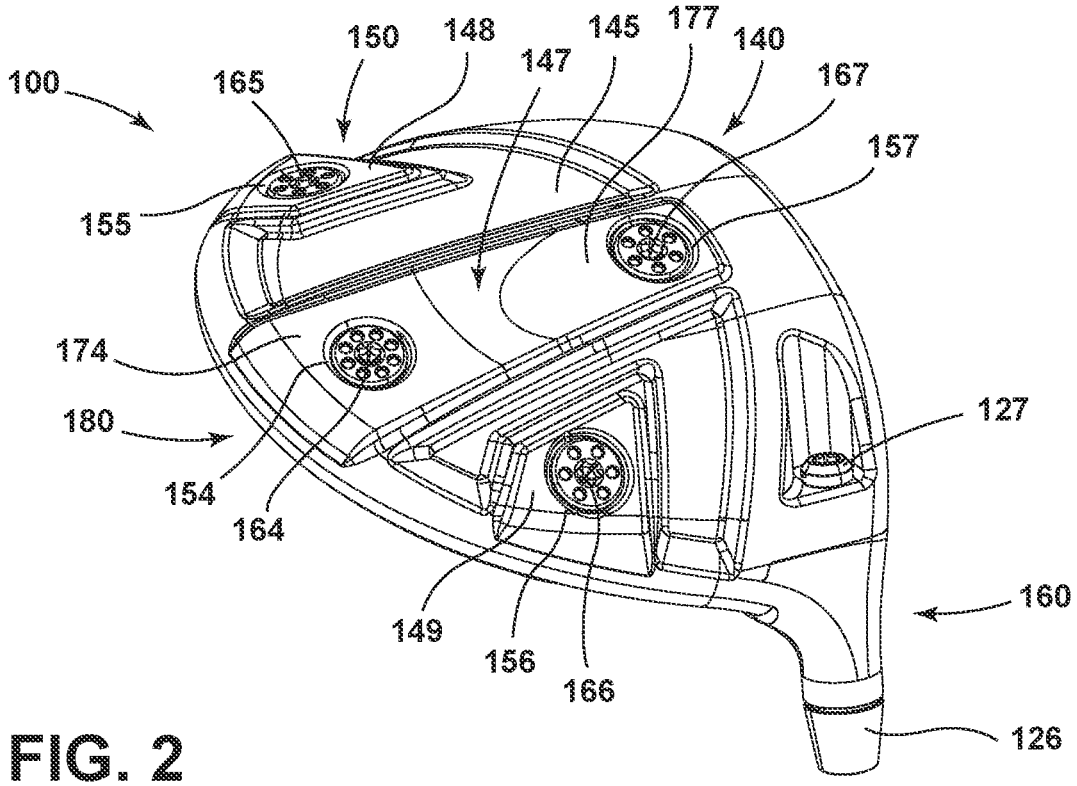
Figure 3:
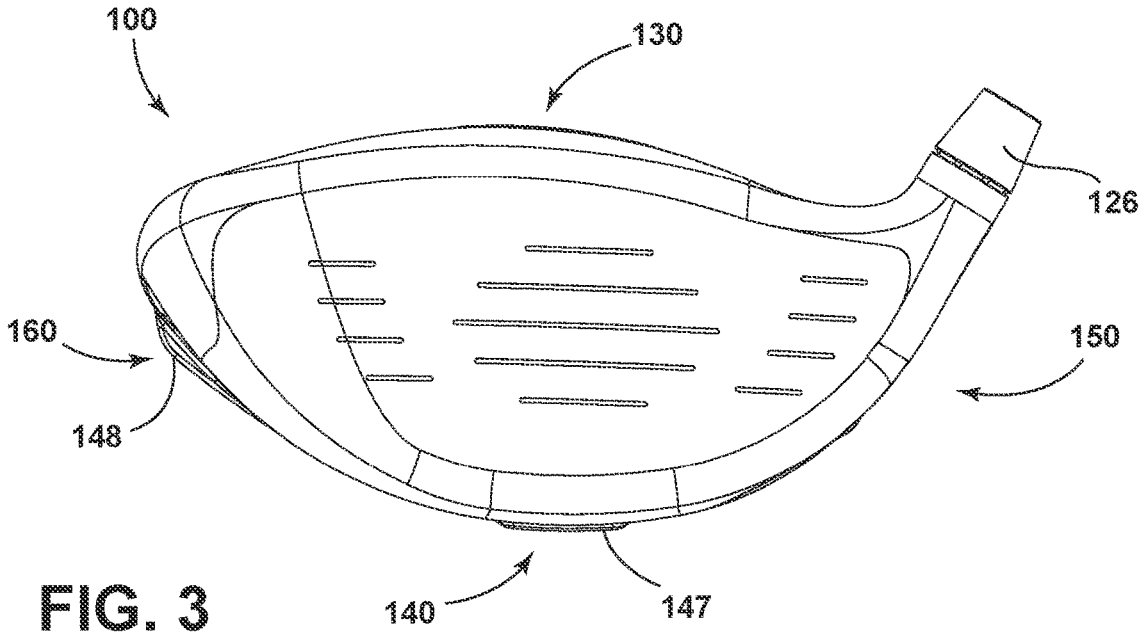
Figure 4:
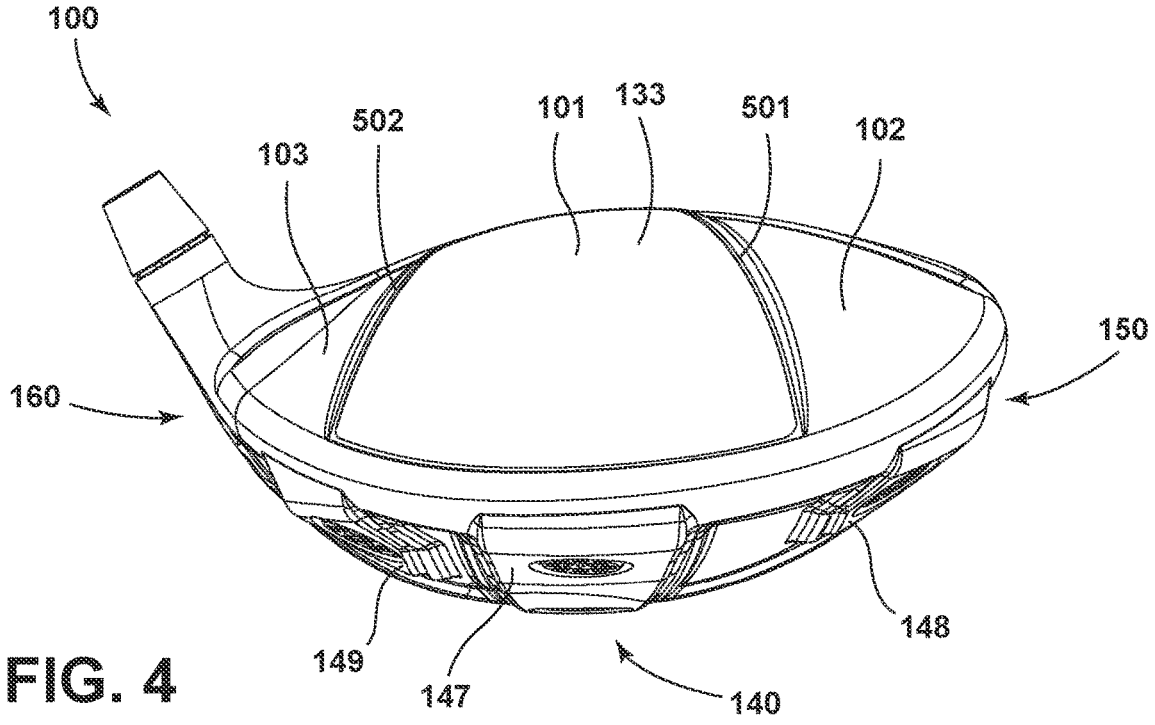

The golf club head 100 may include a central protrusion 147 extending from the outer surface 145 of the sole portion 140. The central protrusion 147 may extend from the rear portion 180 toward the front portion 170, as shown in FIG. 2. The central vertical plane 593 may pass through the central protrusion 147. The central vertical plane 593 may bisect the central protrusion 147. The central protrusion 147 may be located between the toe-side dividing plane 592 and the heel-side dividing plane 594, as shown in FIG. 6. The central protrusion 147 may include the first weight port region 174. The central vertical plane 593 may pass through the first weight port 154 and the first weight portion 164. The central vertical plane 593 may bisect the first weight port 154 and the first weight portion 164. The central protrusion 147 may include the fourth weight port region 177. The central vertical plane 593 may pass through the fourth weight port 157 and the fourth weight portion 167. The central vertical plane 593 may bisect the fourth weight port 157 and the fourth weight portion 167. The central protrusion 147 may allow placement of weight portions (e.g. 164, 167) a greater distance from a center point of the golf club head 100 to increase perimeter weighting and MOI without increasing club head volume. The apparatus, methods, and articles of manufacture described herein are not limited in this regard.

The golf club head 100 may include a toe-side protrusion 148 extending from the outer surface 145 of the sole portion 140. The toe-side protrusion 148 may be located between the toe-side dividing plane 592 and the toe-side bounding plane 591. The toe-side protrusion 148 may be located closer to the rear portion 180 than the front portion 170. The toe-side protrusion 148 may include the second weight port region 175. The toe-side protrusion 148 may allow placement of the weight portion 165 a greater distance from the center point of the golf club head 100 to increase perimeter weighting and MOI without increasing club head volume. The apparatus, methods, and articles of manufacture described herein are not limited in this regard.

The golf club head 100 may include a heel-side protrusion 149 extending from the outer surface 145 of the sole portion 140. The heel-side protrusion 149 may be located between the heel-side dividing plane 594 and the heel-side bounding plane 595. The heel-side protrusion 149 may be located closer to the rear portion 180 than the front portion 170. The heel-side protrusion 149 may include the third weight port region 176. The heel-side protrusion 149 may allow placement of the weight portion 166 a greater distance from the center point of the golf club head 100 to increase perimeter weighting and MOI without increasing club head volume. The apparatus, methods, and articles of manufacture described herein are not limited in this regard.

The golf club head 100 may include an insert 1350. The insert 1350 may be a vibration-dampening insert. The insert 1350 may be a sound-enhancing insert that attenuates certain frequencies. The insert 1350 may include a filler material. As shown in FIG. 9, the insert 1350 may be located on the inner surface 142 of the sole portion 140 of the golf club head 100. The insert 1350 may be adjacent to one or more of the weight port regions. The insert 1350 may surround one or more of the weight ports. The insert 1350 may abut one or more of the weight port regions. The insert 1350 may abut the third weight port region 176. The insert 1350 may be closer to the heel portion 160 than the toe portion 150. The apparatus, methods, and articles of manufacture described herein are not limited in this regard.

Figure 10:
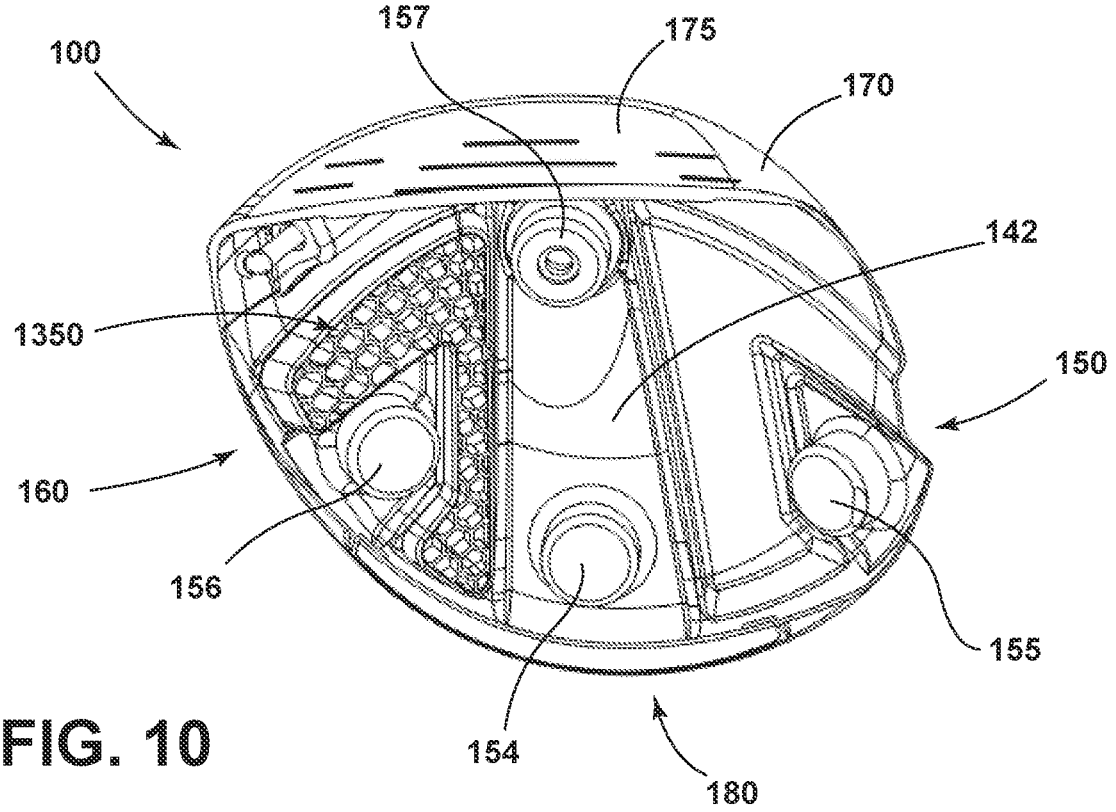
Figure 11:
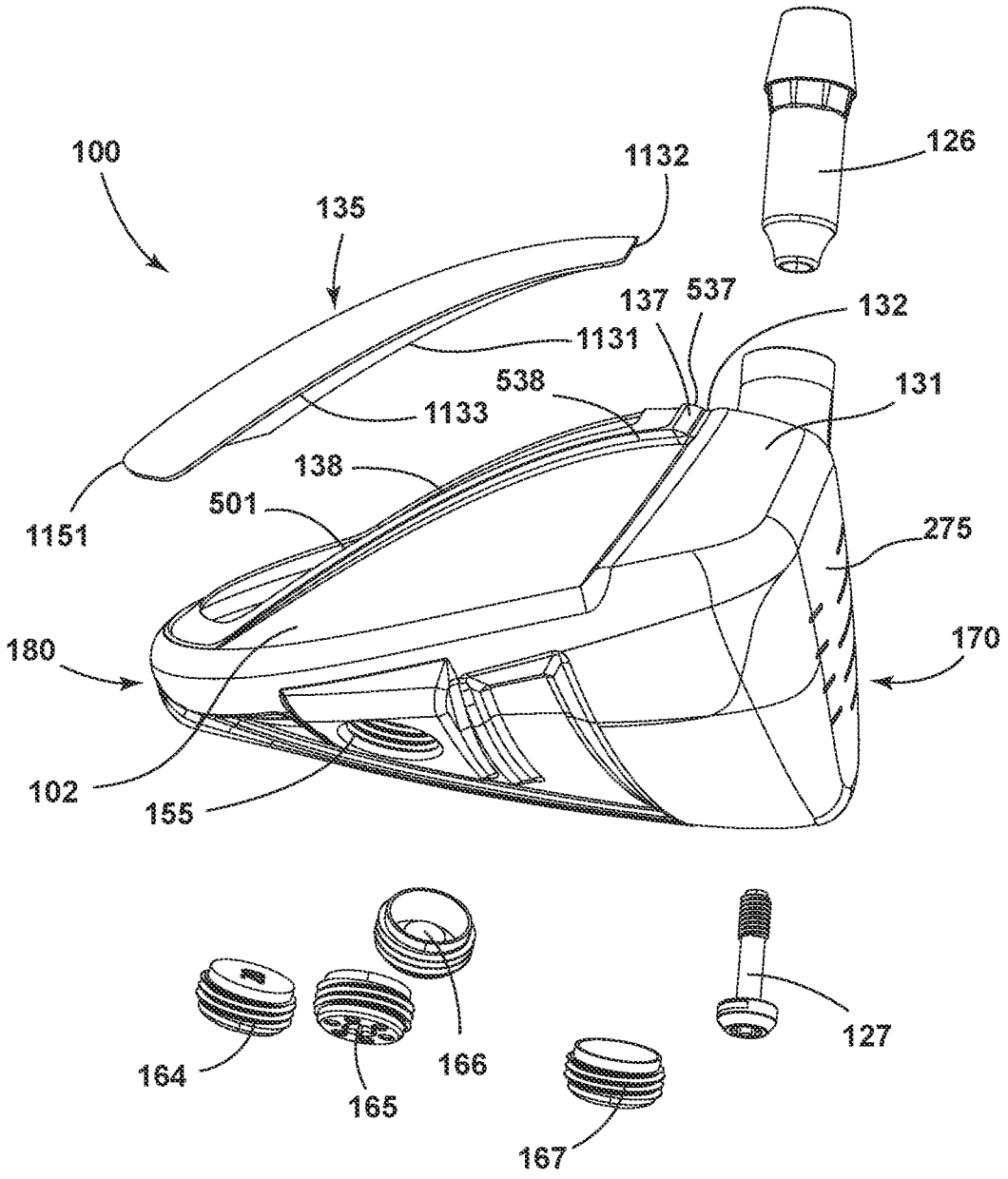

The insert 1350 may be located between the central vertical plane 593 and the heel-side bounding plane 595. The insert 1350 may be located between the heel-side dividing plane 594 and the heel-side bounding plane 595. The insert 1350 may be located between the central protrusion 147 and the heel-side bounding plane 595. The insert 1350 may be located between the heel-side integral rib 539 and the inner surface 142 of the sole portion 140. The insert 1350 may extend from a front side of the third weight port 156 to a rear side of the third weight port, as shown in FIG. 10. The insert 1350 may surround or partially surround the third weight port 156. The insert 1350 may include a plurality of hexagonal recesses. The hexagonal recesses may define a honeycomb pattern. The apparatus, methods, and articles of manufacture described herein are not limited in this regard.

The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience. In yet another example, the filler material may be a thermoset material such as epoxy. The apparatus, methods, and articles of manufacture described herein are not limited in this regard.

Figure 14:
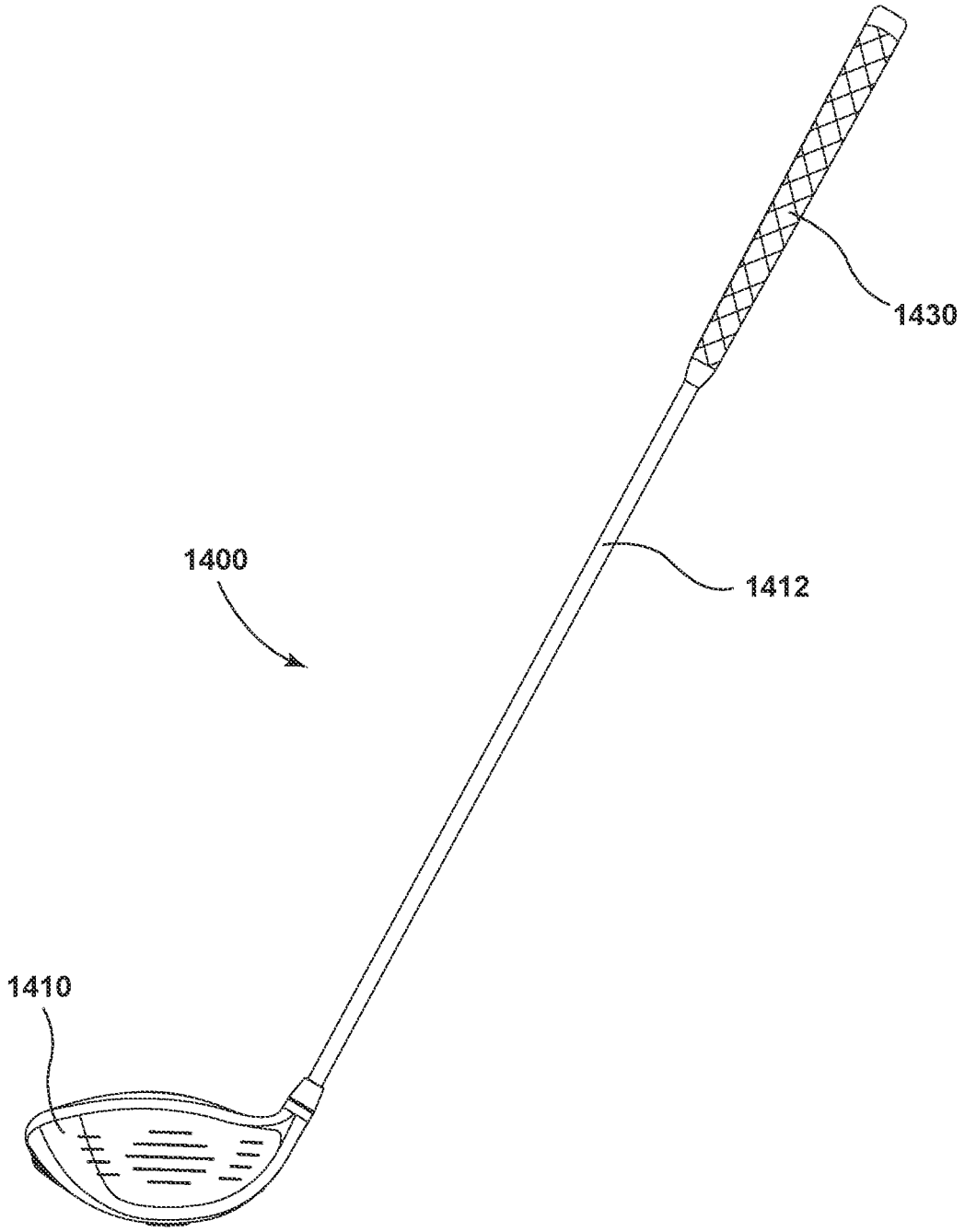
FIG. 14 illustrates a golf club according to any of embodiments of the apparatus, methods, and articles of manufacture described herein.
Figure 15:
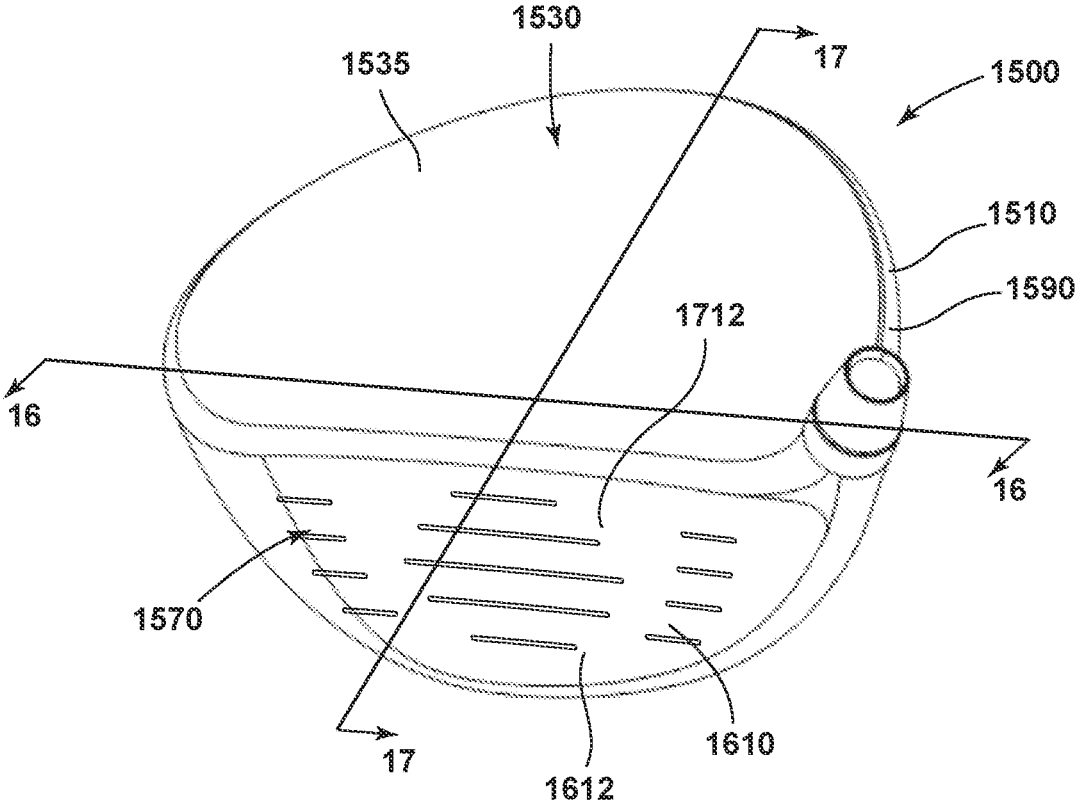
FIGS. 15, 16, 17, 18, 19, 20, 21, 22, 23, 24, 25, 26, 27, 28, and 29 illustrate a front and top perspective view, a cross-sectional view taken along line 16-16 of FIG. 15, a cross-sectional view taken along line 17-17 of FIG. 15, an enlarged view of area 18 of FIG. 17, an enlarged cross-sectional view of area 19 of FIG. 16 taken along line 19-19 of FIG. 16, a back view of a face portion, a back view of a face portion insert, a back view of a face portion with a face portion insert, another back view of a face portion, another back view of a face portion insert, another back view of a face portion with a face portion insert, a perspective view of a face bracket, a perspective view of the face portion with the face portion and the face bracket, and a method of manufacturing, respectively, of an example golf club according to an embodiment of the apparatus, methods, and articles of manufacture described herein.
Figure 16:
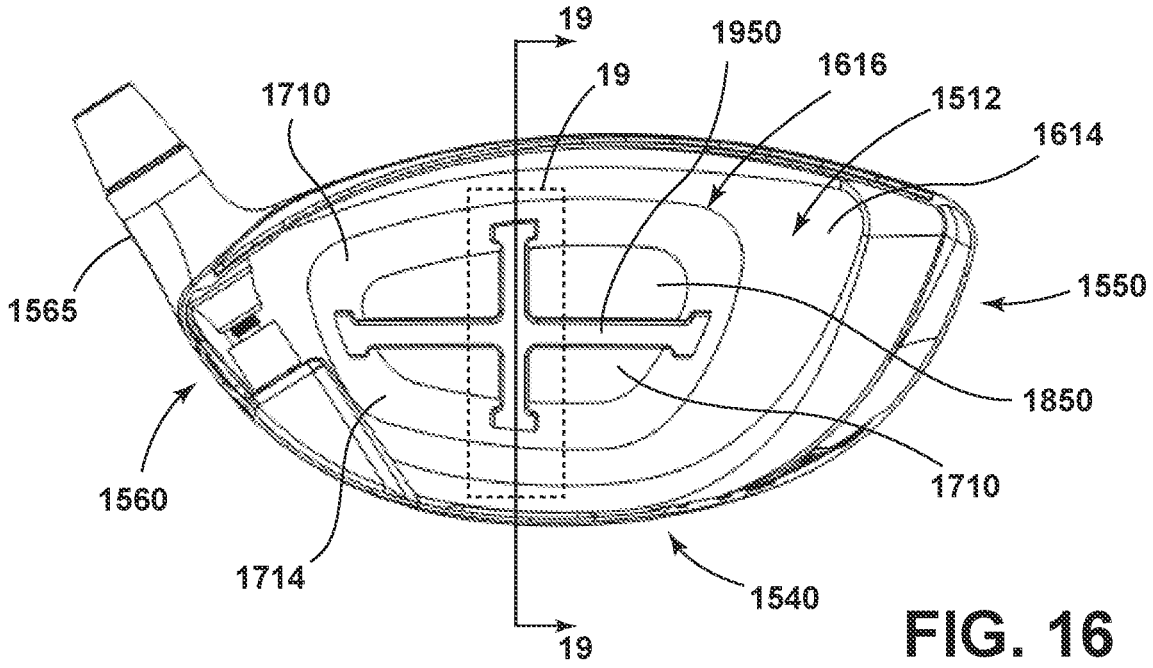
Figure 17:
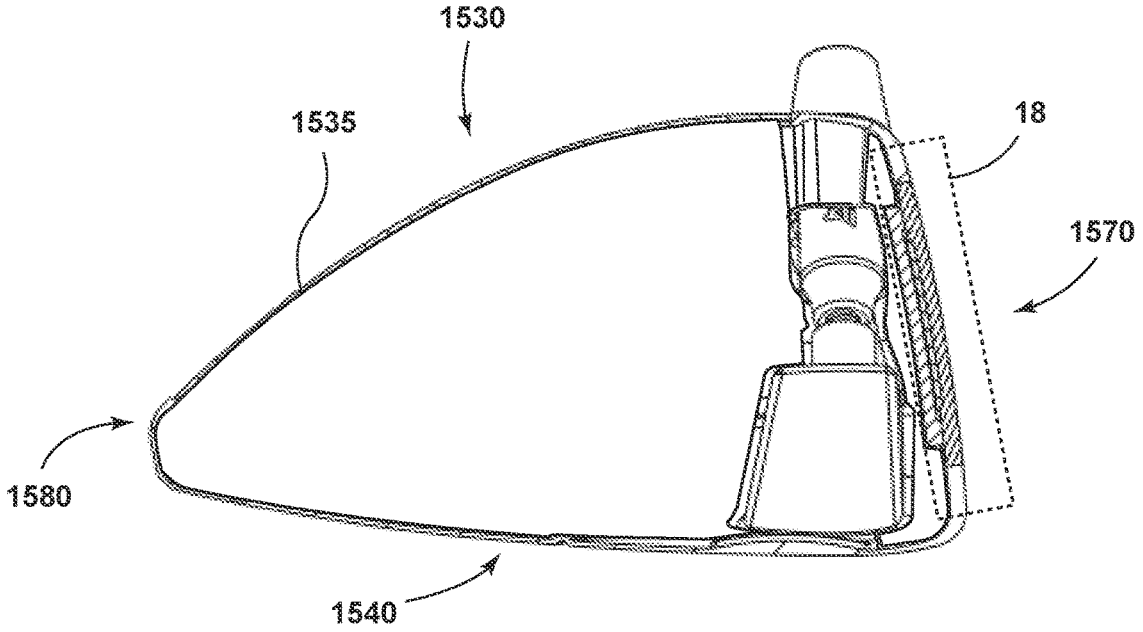
Figure 18:
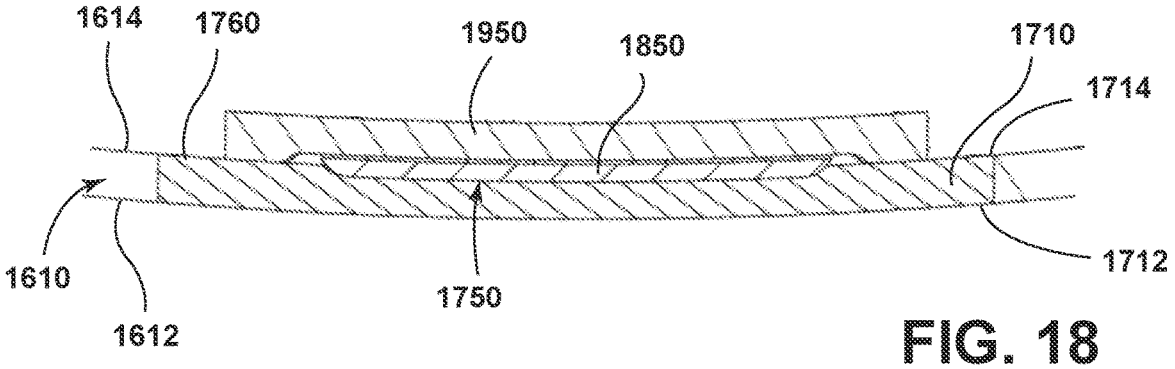
Figure 19:
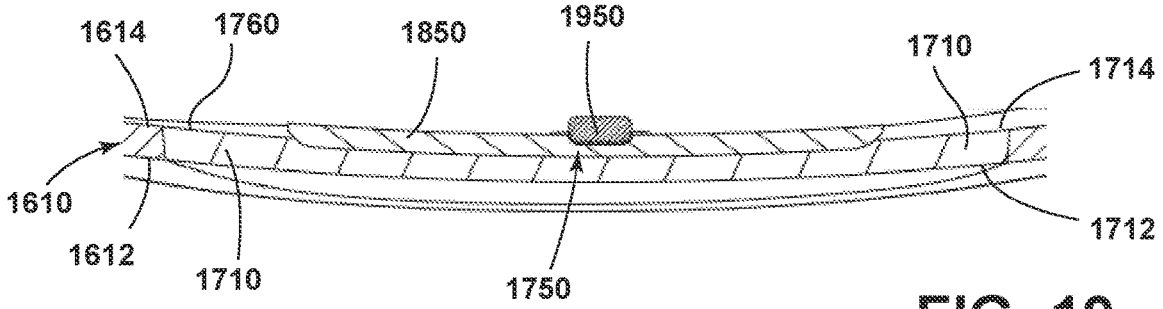
Figure 20:
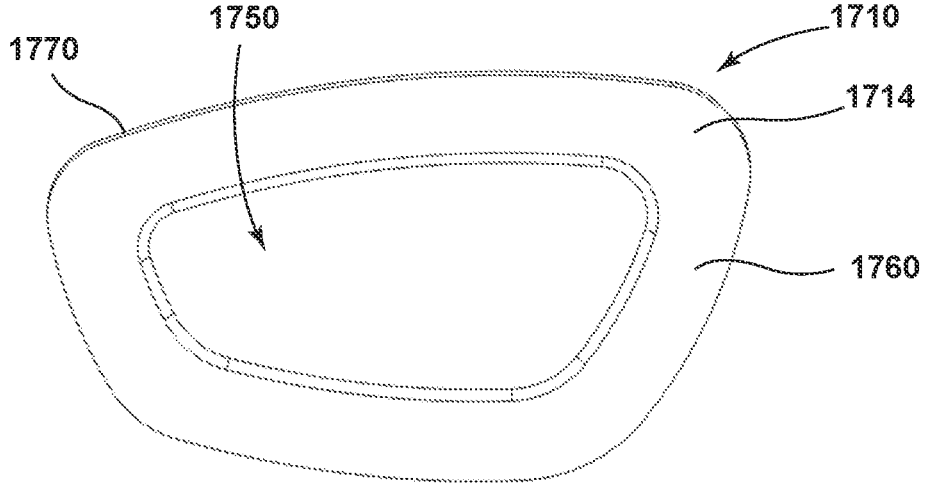
Figure 21:
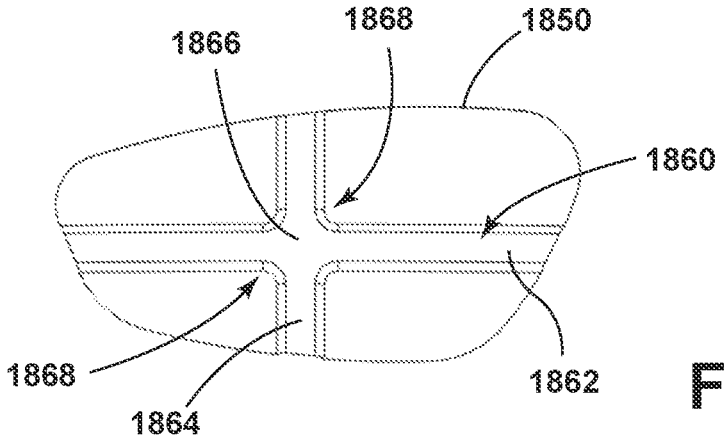
Figure 22:
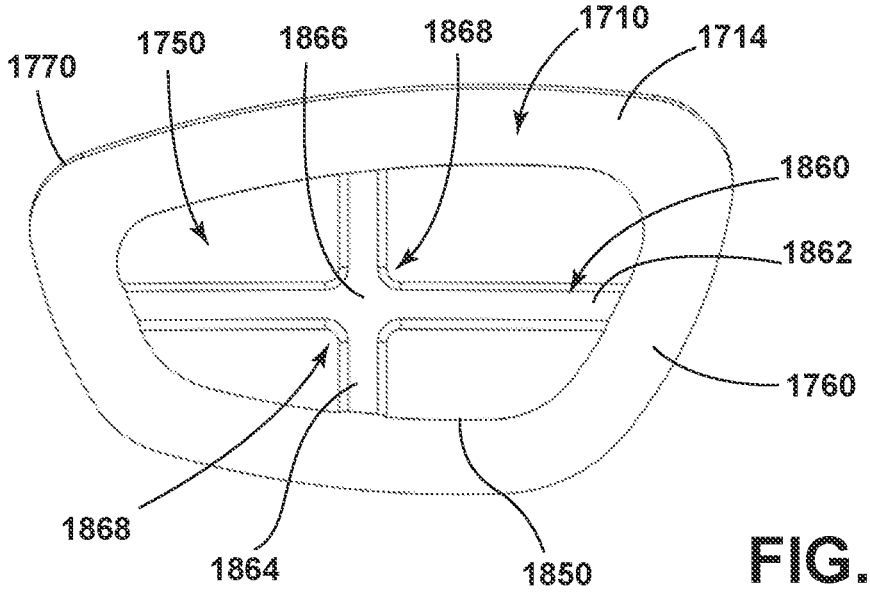
Figure 23:
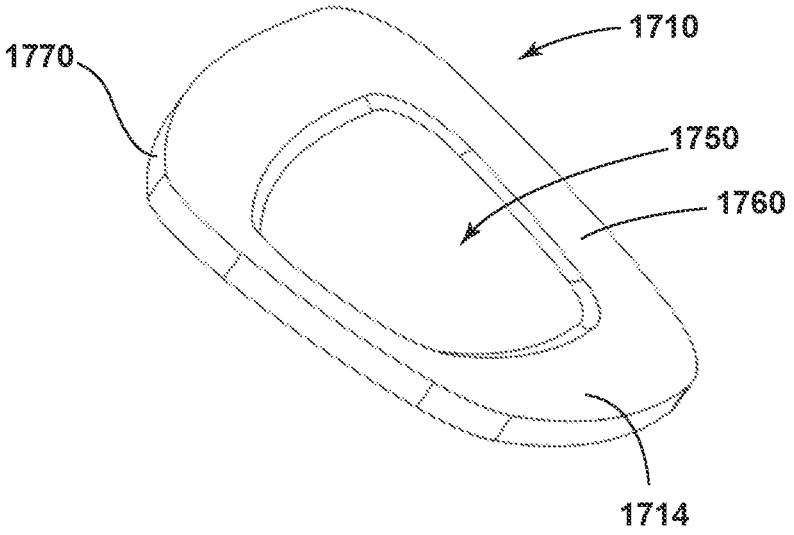
Figure 24:
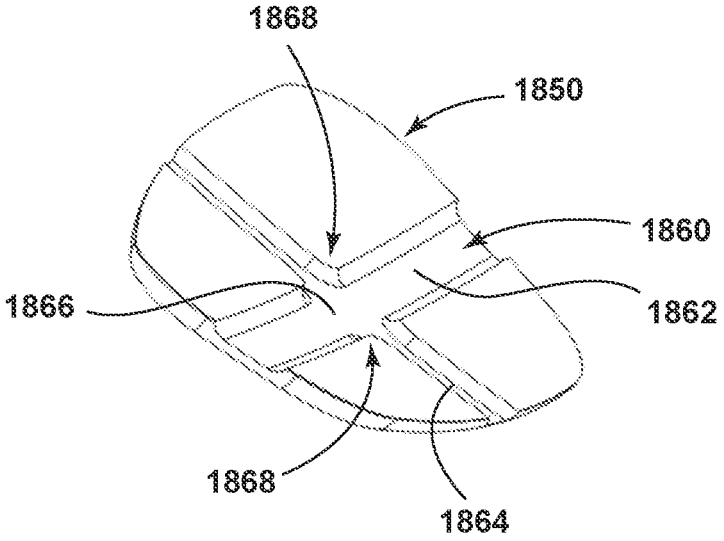
Figure 25:
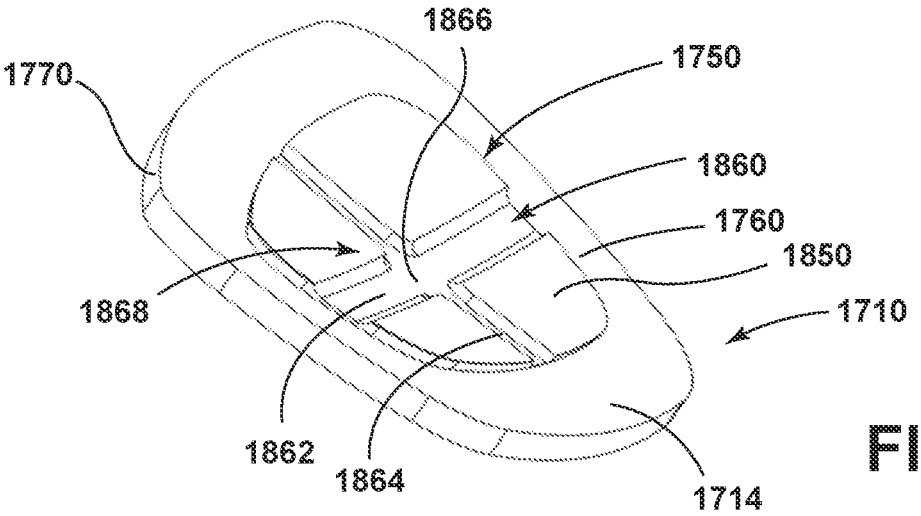
Figure 26:
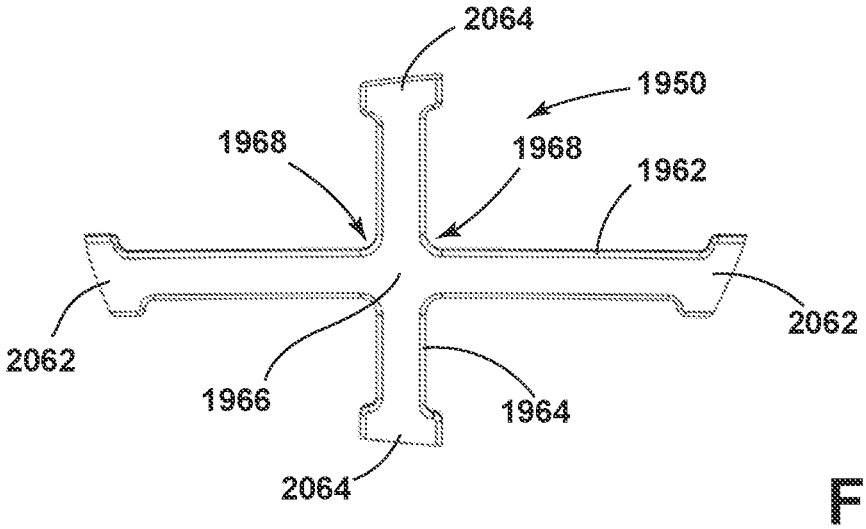
Figure 27:
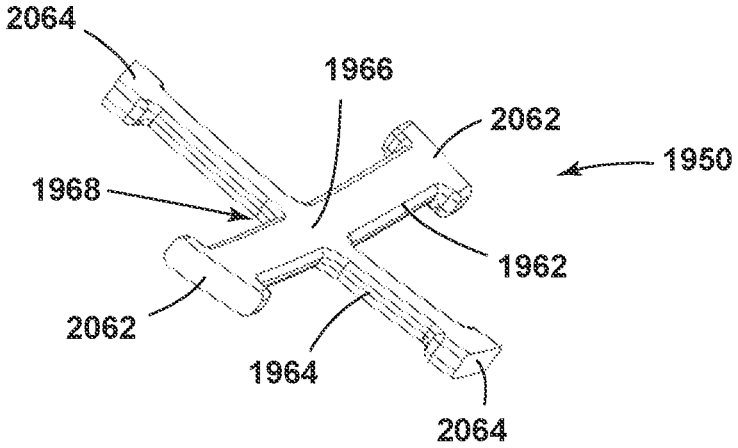
Figure 28:
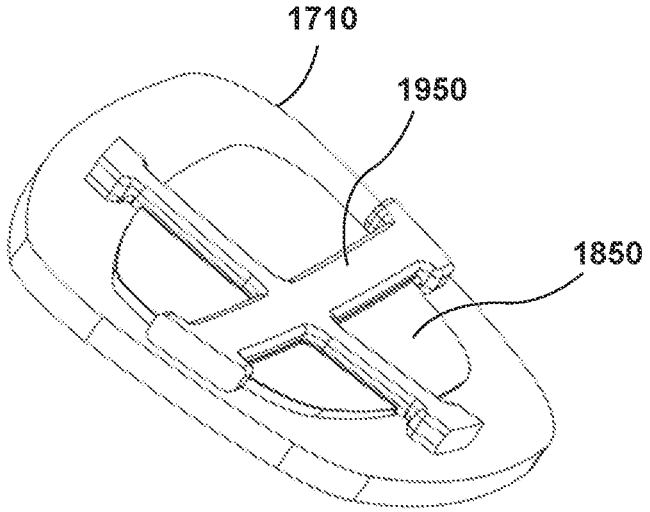

Any of the golf club heads described herein may be component of a golf club. In one example, as illustrated in FIG. 14, a golf club 1400 may include a shaft 1412 extending from a golf club head 1410. The shaft 1412 may be attached to a hosel of the golf club head 1410 at one end and to a grip 1430 at the opposite end. The shaft 1412 may be formed from metal material, composite material, or any other suitable material or combination of materials. The grip 1430 may be formed from rubber material, polymer material, cork, or any other suitable material or combination of materials. The apparatus, methods, and articles of manufacture described herein are not limited in this regard.

In the example of FIGS. 15-28, a golf club head 1500 may include a body portion 1510 which may be hollow to define an interior cavity 1512. The body portion 1510 may include a top portion 1530, a crown portion 1535, a sole portion 1540, a toe portion 1550, a heel portion 1560, a front portion 1570, and a rear portion 1580. The sole portion 1540 may include a skirt portion 1590 defined as a side portion of the golf club head 1500 between the top portion 1530 and the sole portion 1540 excluding the front portion 1570 and extending across a periphery of the golf club head 1500 from the toe portion 1550, around the rear portion 1580, and to the heel portion 1560. Alternatively, the golf club head 1500 may not include the skirt portion 1590. The front portion 1570 may include a face portion 1610 having a front surface 1612 to engage a golf ball and a back surface 1614. The face portion 1610 may be integral to the body portion 1510 or may be partially or fully a separate piece that is coupled (e.g., welded) to the front portion 1570 to enclose an interior cavity 1512 of the body portion 1510. The body portion 1510 may also include a hosel portion 1565 configured to receive a shaft (an example shaft 1412 shown in FIG. 14) having a grip (an example grip 1430 shown in FIG. 14) to form a golf club (an example golf club 1400 shown in FIG. 14). Alternatively, the body portion 1510 may include a bore for receiving a shaft instead of the hosel portion 1565. The body portion 1510 may be made partially or entirely from any of the materials described herein for the golf club head 100 and may be similar in many respects to the golf club head 100 or similar to the golf club heads of any of the incorporated by reference patent documents. The apparatus, methods, and articles of manufacture described herein are not limited in this regard.

In one example, the crown portion 1535 may define a separate crown portion insert that may be attached to the top portion 1530. The crown portion 1535 may be constructed from any material such as a composite material. The crown portion 1535 may enclose an opening in the top portion 1530. In another example, the crown portion 1535 may be co-manufactured with the body portion 1510 as a one-piece continuous part. The configuration of the top portion 1530 and the crown portion 1535 may be similar to any of the configurations of top portions and crown portions that are described herein or in any of the incorporated by reference patent documents. The apparatus, methods, and articles of manufacture described herein are not limited in this regard.

The body portion 1510 may include one or more sets of weight ports, one or more sets of weight portions, and/or one or more filler materials or inserts that may be similar in many respects to any of the weight ports, weight portions, and filler materials or inserts of the golf club head 100, respectively, or to similar parts of any of the golf club heads described in any of the incorporated by reference patent documents. The apparatus, methods, and articles of manufacture described herein are not limited in this regard.

The face portion 1610 may be attached to an opening in the front portion 1570 to close the opening and/or enclose the interior cavity 1512. The face portion 1610 may be co-manufactured with the body portion 1510 and be a one-piece continuous part with the body portion 1510. The configuration of the face portion 1610 relative to the body portion 1510, and the attachment of the face portion 1610 to the body portion 1510 may be similar in many respects to any of the configurations of the face portions and attachments of face portions to the body portions described herein or in any of the incorporated by reference patent documents. The apparatus, methods, and articles of manufacture described herein are not limited in this regard.

In one example as illustrated in FIGS. 15-28, the face portion 1610 may include a face plate portion 1710. The face plate portion 1710 may be attached to an opening 1616 in the face portion 1610 to close the opening 1616 and enclose the interior cavity 1512 at the front portion 1570. The face plate portion 1710 may include a face plate front surface 1712 and a face plate back surface 1714. The face plate front surface 1712 may define a portion of the front surface 1612 of the face portion 1610. The face plate back surface 1714 may define a portion of the back surface 1614 of the face portion 1610. The face plate portion 1710 may have any configuration. In one example, as illustrated in FIGS. 15-28, the face plate portion 1710 may define portions of the face portion 1610 that typically strike a golf ball (i.e., high probability of ball strikes). Accordingly, a center portion of the face plate portion 1710 may coincide with the sweet spot of the face portion 1610. The face plate portion 1710 may be partially or fully constructed from any metal and/or non-metal materials such as aluminum, steel, copper, one or more polymers, ceramic, wood, or composite materials. In the illustrated example of FIGS. 15-28, the face plate portion 1710 may be constructed from a titanium based material and attached to the opening 1616 of the face portion 1610 by welding or soldering. In another example, the face plate portion 1710 may be constructed from a steel based material and attached to the opening 1616 of the face portion 1610 by welding or soldering. In another example, the face plate portion 1710 may be constructed from an aluminum based material and attached to the opening 1616 of the face portion 1610 by welding or soldering. In yet another example, the face plate portion 1710 may be constructed from polymer or composite type material and attached to the opening 1616 of the face portion 1610 mechanically, or by one or more adhesives or fasteners. The apparatus, methods, and articles of manufacture described herein are not limited in this regard.

The face plate portion 1710 may include a recessed portion 1750 on the face plate back surface 1714. The recessed portion 1750 may be centered on the face plate portion 1710 and defines a relatively thinner portion of the face plate portion 1710. The face plate portion 1710 may also include a perimeter portion 1760 around the recessed portion 1750. In one example, as illustrated in FIGS. 15-28, the perimeter portion 1760 may completely surround the recessed portion 1750. Accordingly, the perimeter portion 1760 may define relatively thicker portions of the face plate portion 1710 and be located between the recessed portion 1750 and a perimeter portion edge 1770 of the face plate portion 1710. The perimeter portion 1760 may have a thickness at the perimeter portion edge 1770 that may be similar or substantially similar (considering manufacturing tolerances) to a thickness of the face portion 1610 at the opening 1616. In another example (not shown), the perimeter portion 1760 may partially surround the recessed portion 1750. In another example (not shown), the perimeter portion 1760 may be discontinuous and partially or discretely surround the recessed portion 1750. In another example, the perimeter portion 1760 may have a thickness at the perimeter portion edge 1770 that may be different from a thickness of the face portion 1610 at the opening 1616. In another example, the face plate portion 1710 may not have a recessed portion 1750. In yet another example, the face plate portion 1710 may be similar to any of the face plate portions described herein or described in any of the incorporated by reference patent documents. The apparatus, methods, and articles of manufacture described herein are not limited in this regard.

The face portion 1610 may include a face insert portion 1850 that may be sized and shaped to be inserted in the recessed portion 1750 and fill the recessed portion 1750. In one example, the face insert portion 1850 may have a thickness that may be similar to a depth of the recessed portion 1750 so that the face insert portion 1850 is positioned flush with the perimeter portion 1760. In another example, the face insert portion 1850 may have a thickness that may be greater than a depth of the recessed portion 1750 so as to project above the perimeter portion 1760. In yet another example, the face insert portion 1850 may have a thickness that may be less than a depth of the recessed portion 1750 so as to have a recessed position relative to the perimeter portion 1760. As described herein, in one example, the face plate portion 1710 may not have a recessed portion 1750. Accordingly, the face insert portion 1850 may be attached to and engaged with the face plate back surface 1714 of the face plate portion 1710. The apparatus, methods, and articles of manufacture described herein are not limited in this regard.

The face insert portion 1850 may be constructed from a material that may provide structural support for the face plate portion 1710 while providing sufficient elasticity and rebound effect to increase and/or optimize ball flight characteristics. The face insert portion 1850 may be partially or fully constructed from any metal and/or non-metal materials such as aluminum, steel, copper, one or more polymers, ceramic, wood, or composite materials. In one example, as illustrated in FIGS. 15-28, the face insert portion 1850 may be constructed from a carbon composite material. In another example, the face insert portion 1850 may be constructed from an elastic polymer material. In another example, the face insert portion 1850 may be constructed from a material that may be different than the material of the face plate portion 1710 and/or the material of the face portion 1610. In yet another example, the face insert portion 1850 may be constructed from a material that may be similar to the material of the face plate portion 1710 and/or the material of the face portion 1610. The apparatus, methods, and articles of manufacture described herein are not limited in this regard.

In one example, as illustrated in FIGS. 15-28, the face insert portion 1850 may include one or more channels 1860 (e.g., elongated recesses) configured to receive a face bracket portion 1950. The face bracket portion 1950 may be any type of structure that can support the face portion 1610 and/or impart certain performance properties to the face portion 1610. In the illustrated example of FIGS. 15-28, the face bracket portion 1950 may include a first bracket arm 1962 and a second bracket arm 1964 that may be perpendicular or transverse to each other and joined at a bracket center portion 1966. Accordingly, the channels 1860 of the face insert portion 1850 may include a first channel 1862 for receiving the first bracket arm 1962, a second channel 1864 for receiving the second bracket arm 1964, and a center channel portion 1866 for receiving the bracket center portion 1966. The bracket center portion 1966 may have transition portions 1968 between the first bracket arm 1962 and the second bracket arm 1964 that may be chamfered or rounded and that are received in corresponding channel transition portions 1868 of the face insert portion 1850 and that may be correspondingly rounded or chamfered to reduce or eliminate stress concentrations at or proximate to the center channel portion 1866 and/or the bracket center portion 1966. The first bracket arm 1962 may include opposing end portions 2062, and the second bracket arm 1964 may include opposing end portions 2064. The length of the first bracket arm 1962 may be greater than the length of the first channel 1862 such that the opposing end portions 2062 align with portions of the perimeter portion 1760. The length of the second bracket arm 1964 may be greater than the length of the second channel 1864 such that the opposing end portions 2064 align with corresponding portions of the perimeter portion 1760. As illustrated in the example of FIGS. 15-28, the opposing end portions 2062 and the opposing end portions 2064 may be larger than the remaining portions of the first bracket arm 1962 and the second bracket arm 1964, respectively, to provide enhanced attachment areas between the first bracket arm 1962, the second bracket arm 1964, and the perimeter portion 1760. In another example, the face insert portion 1850 may not include any channels. Accordingly, the face bracket portion 1950 may be attached to or coupled to an outer surface of the face insert portion 1850 (i.e., an outer surface without channels). In another example, the length of the first bracket arm 1962 may not be greater than the length of the first channel 1862 and/or the length of the second bracket arm 1964 may not be greater than the length of the second channel 1864. In another example, the opposing end portions 2062 and the opposing end portions 2064 may have any size, shape, and/or configuration. In another example, the face bracket portion 1950 may include a single bracket arm oriented in any direction to provide certain golf club head performance. Accordingly, the face insert portion 1850 may include a single channel to receive the single bracket arm. In yet another example, the face bracket portion 1950 may include a single bracket arm oriented in any direction to provide certain golf club head performance, and the face insert portion 1850 may not include a channel for receiving the bracket arm. The apparatus, methods, and articles of manufacture described herein are not limited in this regard.

The face bracket portion 1950 may be partially or fully constructed from any metal and/or non-metal materials such as aluminum, steel, copper, one or more polymers, ceramic, wood, or composite materials. In one example, as illustrated in FIGS. 15-28, the face bracket portion 1950 may be constructed from a titanium based material. In another example, as described herein, the face plate portion 1710 may also be constructed from a titanium based material. In another example, the face bracket portion 1950 may be constructed from a composite material. In another example, the face bracket portion 1950 may be constructed from an elastic polymer material. In another example, the face bracket portion 1950 may be constructed from a material that may be different than the material of the face insert portion 1850, the material of face plate portion 1710 and/or the material of the face portion 1610. In yet another example, the face bracket portion 1950 may be constructed from a material that may be similar to the material of the face insert portion 1850, the material of the face plate portion 1710 and/or the material of the face portion 1610. The apparatus, methods, and articles of manufacture described herein are not limited in this regard.

The face insert portion 1850 may be attached to the face plate portion 1710 adhesively, mechanically, by welding, and/or by soldering. In an example where the face insert portion 1850 and/or the face plate portion 1710 may be constructed from a non-metal material such as a carbon composite material as described herein and illustrated in FIGS. 15-28, the face insert portion 1850 may be attached to the face plate portion 1710 by one or more adhesives such as epoxy-type adhesives or bonding agents. The one or more adhesives or bonding agents may be applied in the recessed portion 1750 of the face plate portion 1710 prior to placing the face insert portion 1850 in the recessed portion 1750 as described herein. In an example where both the face insert portion 1850 and the face plate portion 1710 may be constructed from one or more metals or metal alloys, the face insert portion 1850 may be attached to the face plate portion 1710 by one or more adhesives, welding, or soldering. In another example, the face insert portion 1850 may be attached to the face plate portion 1710 by one or more fasteners and/or mechanical locking. In yet another example, the face insert portion 1850 may not be attached to the face plate portion 1710 and may be maintained in the recessed portion 1750 by the face bracket portion 1950 as described herein. The apparatus, methods, and articles of manufacture described herein are not limited in this regard.

The face bracket portion 1950 may be attached to the face insert portion 1850 adhesively, mechanically, by welding, and/or by soldering. In an example where the face insert portion 1850 and/or the face bracket portion 1950 may be constructed from a non-metal material such as a carbon composite material as described herein and illustrated in FIGS. 15-28, the face bracket portion 1950 may be attached to a face insert portion 1850 by one or more adhesives such as epoxy-type adhesives or bonding agents. The one or more adhesives or bonding agents may be applied in the channels 1860 prior to placing the face bracket portion 1950 in the channels 1860 as described herein and illustrated in FIGS. 15-28. In an example where the face insert portion 1850 and/or the face bracket portion 1950 may be constructed from one or more metals or metal alloys, the face insert portion 1850 and the face bracket portion 1950 may be attached together by one or more adhesives, welding, or soldering. In another example, the face insert portion 1850 may be attached to the face bracket portion 1950 by one or more fasteners and/or mechanical locking. In yet another example, face bracket portion 1950 may not be attached to the face insert portion 1850 as described herein. The apparatus, methods, and articles of manufacture described herein are not limited in this regard.

The face bracket portion 1950 may be attached to the perimeter portion 1760 of the face plate portion 1710 adhesively, mechanically, by welding, and/or by soldering depending on the one or more materials by which the face bracket portion 1950 and/or the face plate portion 1710 may be constructed. In the illustrated example of FIGS. 15-28, the opposing end portions 2062 and the opposing end portions 2064 may be welded or soldered to the perimeter portion 1760 to secure the face bracket portion 1950 to the face insert portion 1850. In one example, as illustrated in FIGS. 15-28, the face insert portion 1850 may be attached to the recessed portion 1750 with one or more adhesives or bonding agents, the face bracket portion 1950 may be attached to the face insert portion 1850 with one or more adhesives or bonding agents, and the face bracket portion 1950 may be attached to the perimeter portion 1760 by welding or soldering. In another example, the face insert portion 1850 may not be attached to the recessed portion 1750, the face bracket portion 1950 may be attached to the face insert portion 1850 with one or more adhesives or bonding agents, and the face bracket portion 1950 may be attached to the perimeter portion 1760 by welding or soldering. Accordingly, attachment of the face bracket portion 1950 to the perimeter portion 1760 may maintain the face insert portion 1850 in the recessed portion 1750 and in engagement with the face plate portion 1710. In yet another example, the face insert portion 1850 may not be attached to the recessed portion 1750, the face bracket portion 1950 may not be attached to the face insert portion 1850, and the face bracket portion 1950 may be attached to the perimeter portion 1760 by welding or soldering. Accordingly, attachment of the face bracket portion 1950 to the perimeter portion 1760 may maintain the face insert portion 1850 in the recessed portion 1750 and engaged with both the face plate portion 1710 and the face bracket portion 1950. The apparatus, methods, and articles of manufacture described herein are not limited in this regard.

Figure 29:
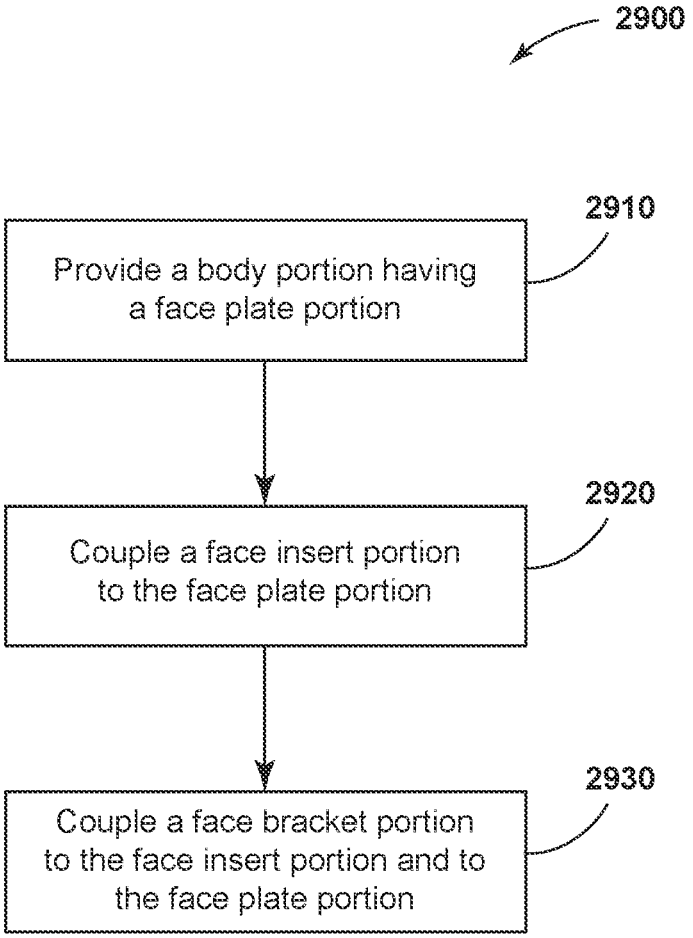

In one example, as illustrated in FIG. 29, a method 2900 of manufacturing the golf club head 1500 may include providing a body portion 1510 having a face plate portion 1710 (block 2910). A face insert portion 1850 may be coupled or attached to the face plate portion 1710 (block 2920) as described herein. A face bracket portion 1950 may be coupled or attached to the face insert portion 1850 and attached to the face plate portion 1710 (block 2930) as described herein. In one example, the face plate portion 1710 may be attached to the body portion 1510 prior to attachment of the face insert portion 1850 and the face bracket portion 1950 to the face plate portion 1710. In another example, the face plate portion 1710 may be attached to the body portion 1510 after to attachment of the face insert portion 1850 and the face bracket portion 1950 to the face plate portion 1710. The apparatus, methods, and articles of manufacture described herein are not limited in this regard.

Figure 30:
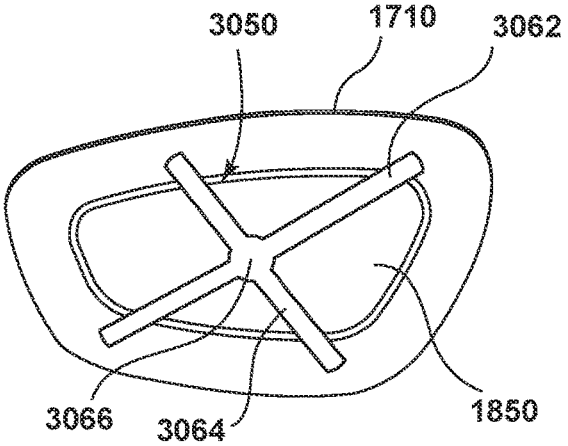
FIGS. 30-35 illustrate back views of examples of face portion inserts according to embodiment of the apparatus, methods, and articles of manufacture described herein.
Figure 31:
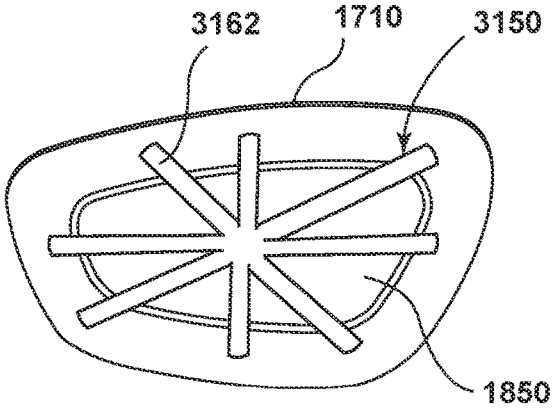
Figure 32:
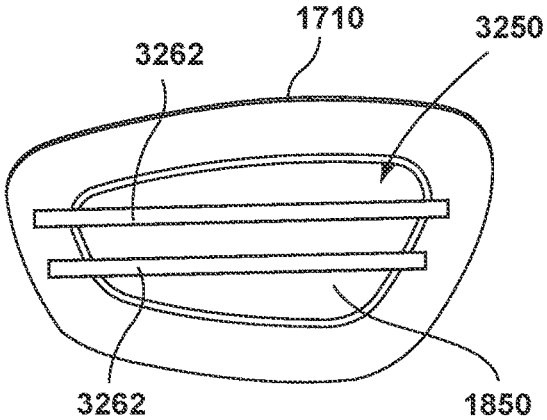
Figure 33:
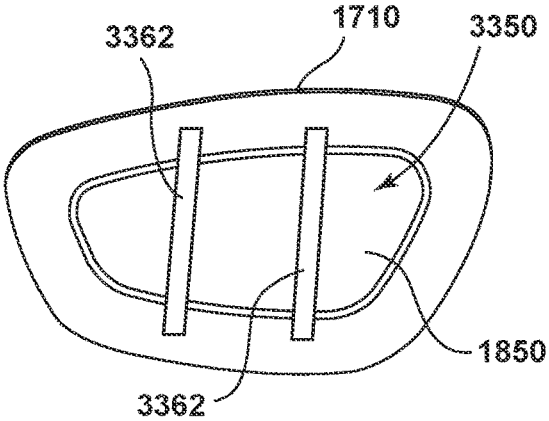
Figure 34:
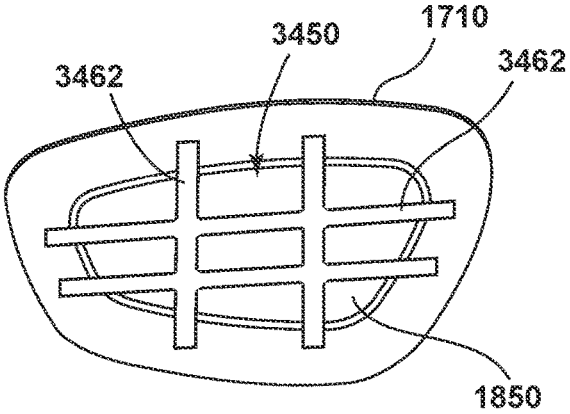
Figure 35:
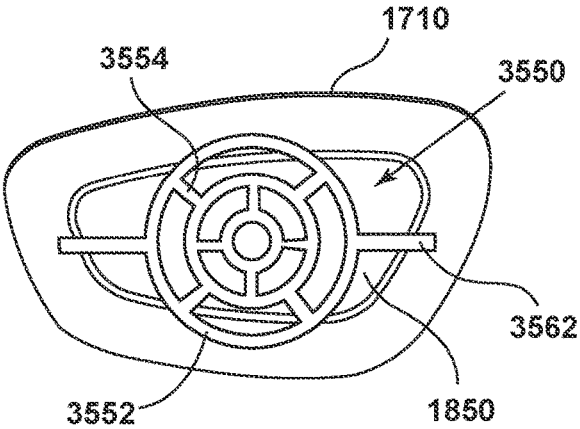
Figure 36:
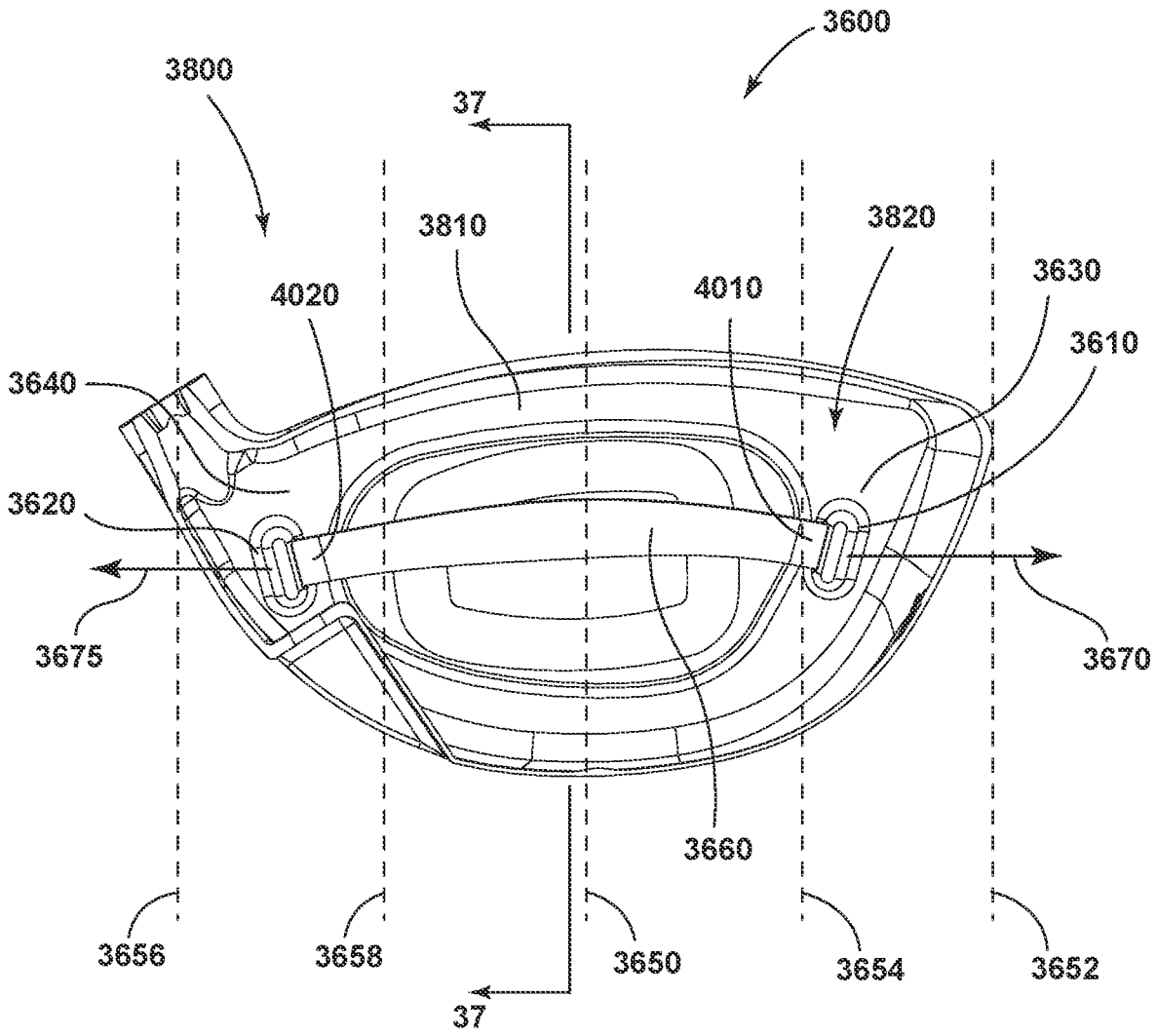
FIG. 36 illustrates a cross-sectional view of a golf club head configured with a system for improving Coefficient of Restitution (COR) according to an embodiment of the apparatus, methods, and articles of manufacture described herein.
Figure 37:
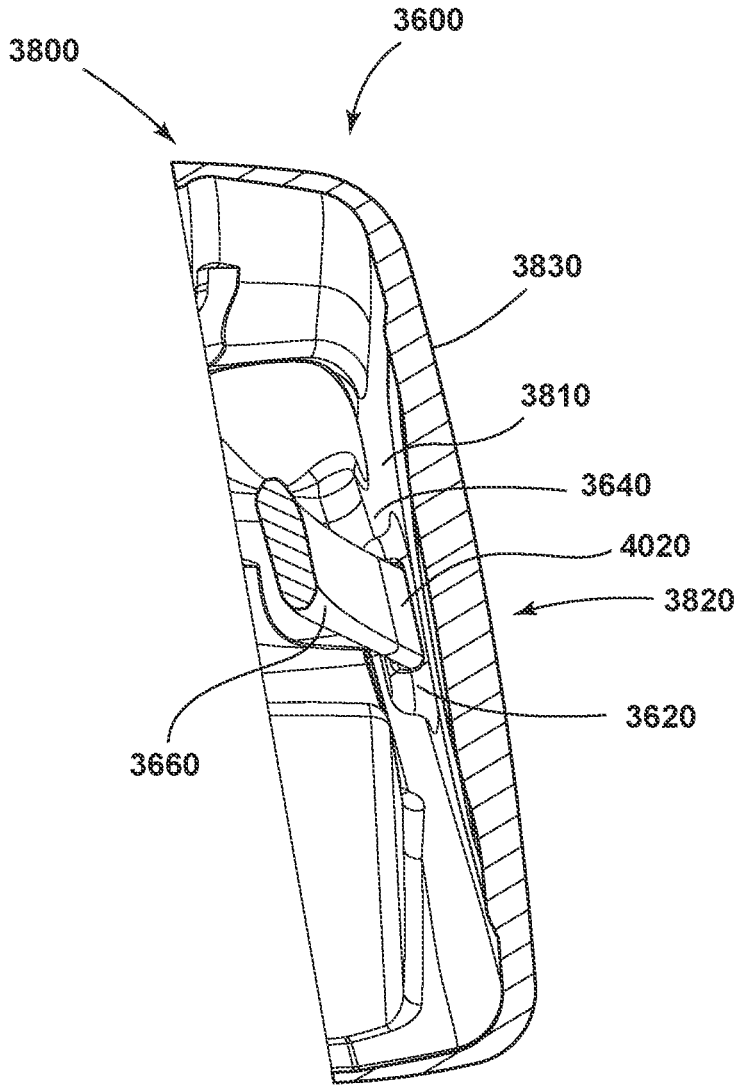
FIG. 37 illustrates a cross sectional view of the golf club head of FIG. 36 taken at lines 37-37 of FIG. 36.
Figure 38:
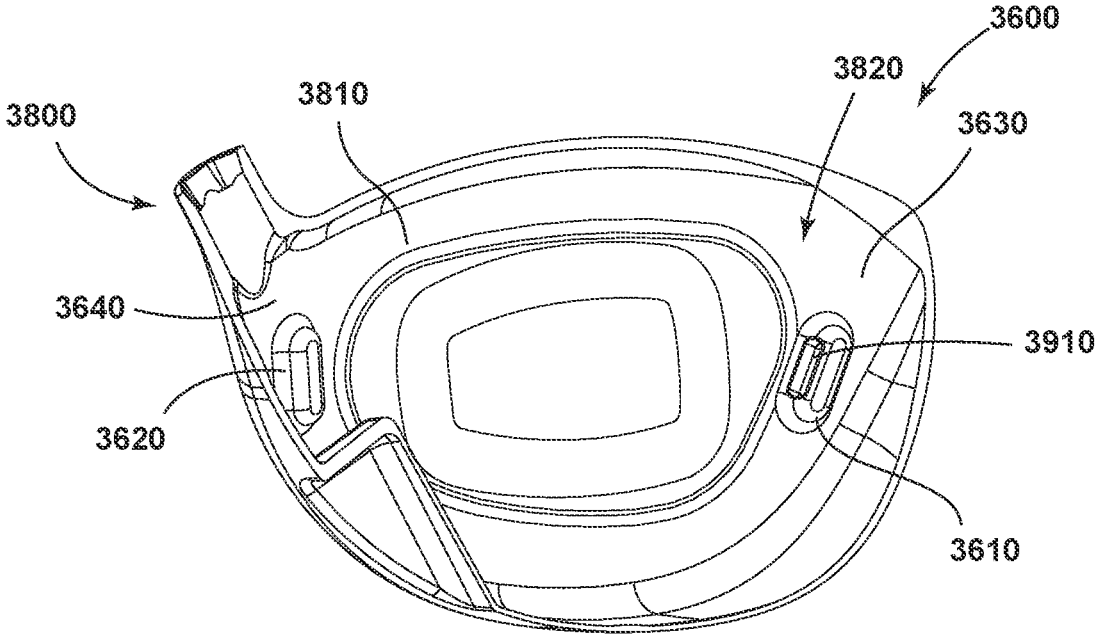
FIG. 38 illustrates a heel and rear perspective view of the golf club head of FIG. 36 and depicts certain features of the system for improving COR.
Figure 39:
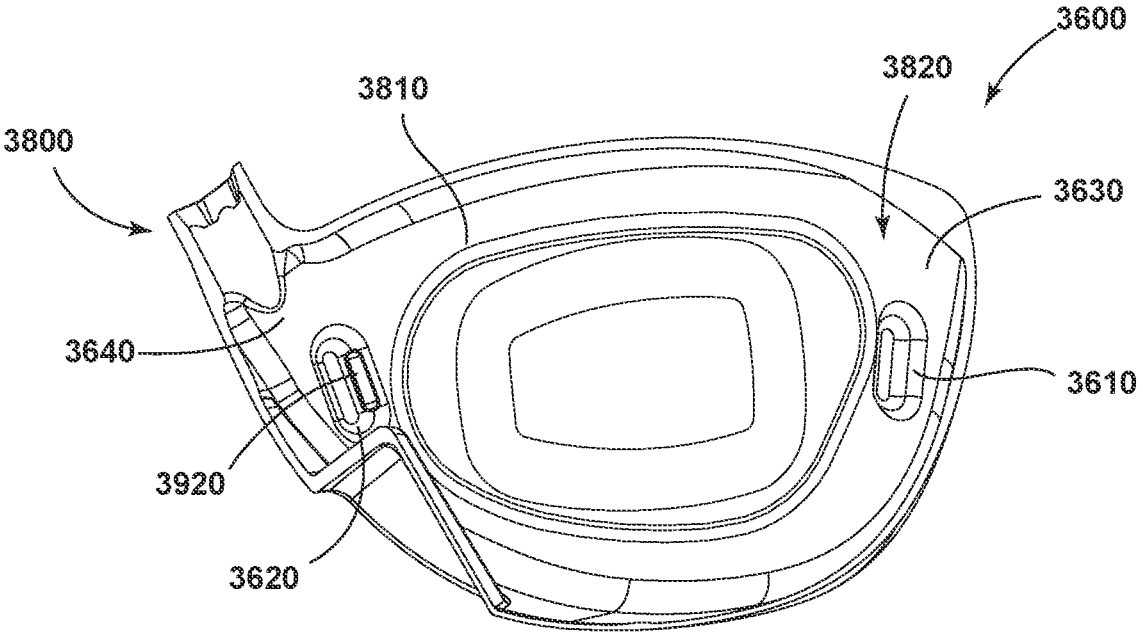
FIG. 39 illustrates a toe and rear perspective view of the golf club head of FIG. 36 and depicts certain features of the system for improving COR.
Figure 40:
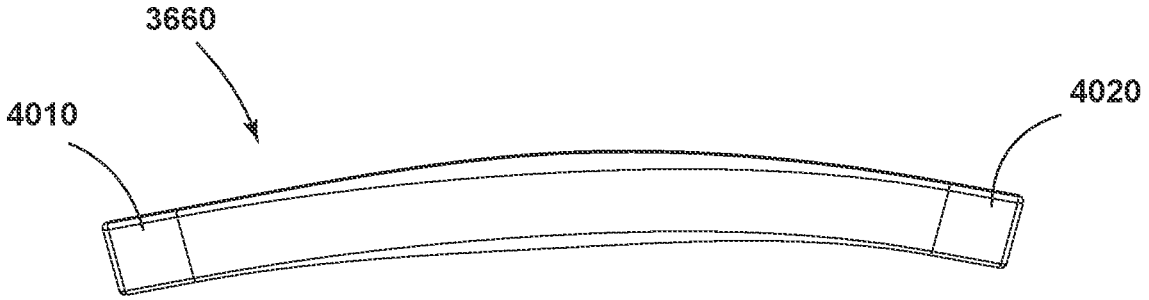
FIG. 40 illustrates a front perspective view of a bridge structure of the system for improving COR according to an embodiment of the apparatus, methods, and articles of manufacture described herein.
Figure 41:
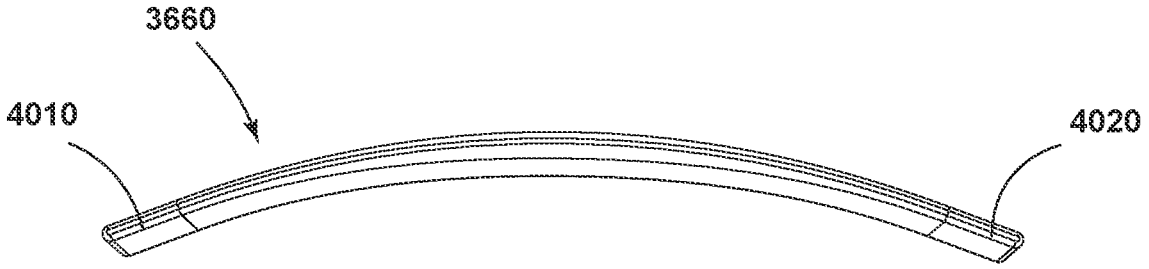
FIG. 41 illustrates a top perspective view of the bridge structure of FIG. 40.

In the examples of FIGS. 15-28, certain configurations of the face insert portion 1850 and the face bracket portion 1950 are illustrated and described herein. In another example, as illustrated in FIG. 30, a face bracket portion 3050 may include a first bracket arm 3062 and a second bracket arm 3064 that may be oriented transverse or perpendicular to each other and joined at a bracket center portion 3066. The face bracket portion 3050 may be engaged with the face insert portion 1850 so that the first bracket arm 3062 and the second bracket arm 3064 are arranged in a diagonal orientation as compared to the illustrated examples of FIGS. 15-28. In another example, as illustrated in FIG. 31, a face bracket portion 3150 may include a plurality of bracket arms 3162 that may be a combination of the bracket arms of the face bracket portion 1850 and the face bracket portion 3050. In another example, as illustrated in FIG. 32, a face bracket portion 3250 may include two independent bracket arms 3262 (i.e., not attached or joined) that may be vertically spaced apart and oriented horizontally. In another example, as illustrated in FIG. 33, a face bracket portion 3350 may include two independent bracket arms 3362 (i.e., not attached or joined) that may be horizontally spaced apart and oriented vertically. In another example, as illustrated in FIG. 34, a face bracket portion 3450 may include a combination of the face bracket portion 3250 and the face bracket portion 3350 with corresponding bracket arms 3462 joining with rounded or chamfered connections at the bracket arm intersection regions. In yet another example, as illustrated in FIG. 35, a face bracket portion 3550 may include a plurality of concentric support loops 3552 that may be circular (as illustrated in FIG. 35), may be oval or elliptical, or may have a shapes that resemble the shape of the perimeter portion edge 1770 (i.e., shaped similar to the face plate portion 1710). The support loops 3552 may be connected by a plurality of radial arms 3554. The face bracket portion 3550 may include a plurality of outer arms 3562 that may be attached to the perimeter portion 1760 to secure the face bracket portion 3550 to the face plate portion 1710. An outer support loop 3552 may also be attached to the perimeter portion 1760 as illustrated in the example of FIG. 35. The at least an outer support loop, several support loops, or all of the concentric support loops 3552 of face bracket portion 3550 may be oval and/or elliptical without having any outer arms such that all or portions of the outer support loop of the face bracket portion 3550 may be attached to the perimeter portion 1760. In one example, the face insert portion 1850 may include corresponding channels as described herein to receive the face bracket portion illustrated in FIGS. 30-35 and described herein. In another example, the face insert portion 1850 may not include any channels such that the face bracket portion illustrated in FIGS. 30-35 and described herein may engage or be attached to an outer surface of the face insert portion 1850. In yet another example, any of the face bracket portions described herein, such as the face bracket portion 1950 may be attached to the face plate portion 1710 without using a face insert portion, such as the face insert portion 1850. The face bracket portion 1950 may be attached to and on top of the face plate back surface 1714. Alternatively, the face plate back surface 1714 may include a plurality of channels, such as the channels 1860 to receive corresponding bracket arms of the face bracket portion 1950. The apparatus, methods, and articles of manufacture described herein are not limited in this regard.

The combination of face plate portion 1710 including the recessed portion 1750, the face insert portion 1850, and the face bracket portion 1950 as described herein may increase and/or optimize the coefficient of restitution (COR) of a golf club head. Additionally, sound and vibration of the golf club head may be dampened, improved, and/or optimized by any one or a combination of face plate portion 1710 including the recessed portion 1750, the face insert portion 1850, and the face bracket portion 1950. The material of construction (e.g., metal, polymer, composite) and/or the physical properties (e.g., thickness, length, relative size) of each of the face plate portion 1710, the face insert portion 1850, and the face bracket portion 1950 may be selected in order to optimize the performance of a golf club head (e.g., ball speed, trajectory, spin, carry distance), improve COR, and/or reduce or dampen sound and vibration. The apparatus, methods, and articles of manufacture described herein are not limited in this regard.

Any of the components of any of the golf club heads described herein, such as the face insert portion 1850, may be constructed from a single layer of a composite material or a plurality of composite material layers in a stacked arrangement such as a carbon composite material. A layer of composite material may include a layer of fabric combined with an amount of resin. The fabric may be constructed from graphite fiber (commonly referred to as "carbon fiber"). In another example the composite material may be constructed from glass fiber, aramid fiber, carbon nanotubes, or any other suitable high-performance fiber, combination of fibers, or material. In some examples, the fabric may be a hybrid of two or more types of fibers, such as a hybrid fabric made of carbon fibers and aramid fibers. Examples of aramid fibers include KEVLAR, TWARON, NOMEX, NEW STAR, TECHNORA, and TEIJINCONEX fibers. The fabric may be constructed as a woven, knitted, stitched, or nonwoven (e.g. uni-directional) fabric. Examples of suitable woven fabrics include Style 7725 Bi-directional E-Glass (Item No. 1094), Twill Weave Carbon Fiber Fabric (Item No. 1069), and KEVLAR Plain Weave Fabric (Item No. 2469), all available from Fibre Glast Developments Corporation of Brookville, Ohio.

In some instances, resin may be applied to the fabric during a lamination process, either by hand or through an infusion process. In other instances, the fabric may be pre-impregnated with resin. These fabrics are commonly referred to as "prepreg" fabrics. Prepreg fabrics may require cold storage to ensure the resin does not cure prematurely. During manufacturing, heating the face insert portion 1850 may be required to fully cure (i.e. polymerize) the resin such that the face insert portion 1850 takes on desirable structural attributes as the resin hardens. The apparatus, methods, and articles of manufacture described herein are not limited in this regard.

In some examples, the resin may be a thermosetting resin, such as an epoxy resin, vinyl-ester resin, polyester resin, or other suitable resin. Resin selection may be based, at least in part, on fabric compatibility and the characteristics of the composite layers. Epoxy resins are suitable since they may be used to form a face insert portion 1850 that may be strong, lightweight, and dimensionally stable. A suitable epoxy resin is System 2000 Epoxy Resin (Item No. 2000-A) available from Fibre Glast Developments Corporation.

The epoxy resin may be mixed with a suitable epoxy hardener, such as 2020 Epoxy Hardener (Item No. 2020-A), 2060 Epoxy Hardener (Item No. 2060-A), or 2120 Epoxy Hardener (Item No. 2120-A) from Fibre Glast Developments Corporation. Selection of an epoxy hardener may be based, at least in part, on desired pot life and working time, which may be dictated by the size and complexity of the face insert portion 1850 being manufactured. Epoxy hardener selection may also be based on desired cure temperature and cure time. An epoxy hardener may be selected that is compatible with the chosen manufacturing temperature and time. The apparatus, methods, and articles of manufacture described herein are not limited in this regard.

The face insert portion 1850 may be formed by any suitable process, such as a wet layup process where liquid resin is distributed over a fabric made of fibers to wet out the fabric. The liquid resin may be distributed by hand, by a resin infusion process, or by any other suitable process. The wet layup process may utilize a peel ply layer or mold release agent to prevent the face insert portion 1850 from adhering to a vacuum bagging film during a vacuum bagging process. An example of a suitable peel ply layer is Peel Ply Release Fabric (Catalog No. VB-P56150) available from U.S. Composites, Inc. of West Palm Beach, Florida.

During the layup process, fabric may be trimmed to an appropriate size and then laid down over a mold. Resin may then be applied to the surface of the fabric using any suitable tool, such as a roller or brush. Through a lamination process, the resin may be forced into the fabric to impregnate the fabric with resin. When prepreg fabrics are used in the layup, the step of applying resin may be omitted, since the fabric already contains a suitable amount of resin to facilitate the lamination process. A peel ply layer may be inserted between the prepreg fabric and the vacuum bagging film to prevent the face insert portion 1850 from adhering to the vacuum bagging film. The apparatus, methods, and articles of manufacture described herein are not limited in this regard.

The plurality of composite layers may include a plurality of layers of composite materials arranged in a stacked configuration. In one example, the plurality of composite layers may include two or more layers of prepreg uni-directional fabric. In another example, the plurality of composite layers may include three or more layers of prepreg uni-directional fabric. In still another example, the plurality of composite layers may include four or more layers of prepreg uni-directional fabric where four layers are arranged in a 0/90/0/90 configuration to increase tensile strength along two perpendicular axes. The apparatus, methods, and articles of manufacture described herein are not limited in this regard.

In the example of FIGS. 36-41, a golf club head 3800 may include a system 3600 for improving COR. The golf club head 3800 may be similar in many respects to any of the golf club heads described herein. Additionally, any of the golf club heads described herein may be configured with the system 3600 outlined below. In the illustrated example, a first protrusion 3610 and a second protrusion 3620 may be coupled to a rear surface 3810 of a face portion 3820. The face portion 3820 may also include a front surface 3830 opposite the rear surface 3810 and generally define a strike surface of the golf club head 3800. The properties and configuration of the face portion 3820, such as the thickness profile of the face portion or the thickness profiles of sections of the face portion 3820 may be similar in many respects to the face portion described in U.S. Patent Application Publication No. 20220072393, which is incorporated herein by reference, or described in any of the incorporated by reference patent documents. The apparatus, methods, and articles of manufacture described herein are not limited in this regard.

The first protrusion 3610 may be located at a toe-side portion 3630 of the rear surface 3810 and the second protrusion 3620 may be located at a heel-side portion 3640 of the rear surface 3810. Accordingly, the first protrusion 3610 may be also referred to herein as the toe-side protrusion, and the second protrusion 3620 may be also referred to herein as the heel-side protrusion. In one example, the toe-side portion 3630 may include a portion of the rear surface 3810 located between a center longitudinal plane 3650 and a toe-side bounding plane 3652 of the golf club head 3800. In another example, the toe-side portion 3630 may include a portion of the rear surface 3810 located between the toe-side bounding plane 3652 and a toe-side dividing plane 3654 located between and equidistant to the center longitudinal plane 3650 and the toe-side bounding plane 3652. In one example, the heel-side portion 3640 may include a portion of the rear surface 3810 located between the center longitudinal plane 3650 and a heel-side bounding plane 3656 of the golf club head 3800. In another example, the heel-side portion 3640 may include a portion of the rear surface 3810 located between the heel-side bounding plane 3656 and a heel-side dividing plane 3658 located between and equidistant to the center longitudinal plane 3650 and the heel-side bounding plane 3656. The first protrusion 3610 and the second protrusion 3620 may be made from a material similar to or different from the face portion 3820 including any of the materials described herein. In one example, the first protrusion 3610 and/or the second protrusion 3620 may be integral with the face portion 3820. In another example, the first protrusion 3610 and/or the second protrusion 3620 may be provided separately and joined to the face portion 3820 (e.g., via welding, mechanical fasteners, adhesives, a combination thereof, or the like). The first protrusion 3610 and/or the second protrusion 3620 may be oblong having a uniform or variable cross section. The first protrusion 3610 and/or the second protrusion 3620 may each include a corresponding receptacle shown as a first receptacle 3910 and a second receptacle 3920. In one example, the first receptacle 3910 and the second receptacle 3920 may be defined by slits or slots. The first receptacle 3910 and the second receptacle 3920 may be oriented to point slightly away from the rear surface 3810 in a club-inward direction. The apparatus, methods, and articles of manufacture described herein are not limited in this regard.

In one example, as illustrated in FIGS. 36-41, a bridge structure 3660 may be removably coupled to the first protrusion 3610 and the second protrusion 3620 and may extend between the first protrusion 3610 and the second protrusion 3620. The bridge structure 3660 may extend laterally in a toe-to-heel direction. The bridge structure 3660 may be coupled to the first protrusion 3610 and the second protrusion 3620 by any means. In one example, as illustrated in FIGS. 36-41, the bridge structure 3660 may include a first end portion 4010 configured to be entirely or partially received in the first receptacle 3910 and a second end portion 4020 configured to be entirely or partially received in the second receptacle 3920 to assemble the bridge structure 3660 to the face portion 3820. The bridge structure 3660 may be flexible or semi-rigid and may be straight or have a slight bow in a disassembled state. The bridge structure 3660 may have a length determined such that the bridge structure 3660 is compressed when assembled to the first protrusion 3610 and the second protrusion 3620. In the assembled state, the bridge structure 3660 may exhibit increased bowing in a direction away from the rear surface 3810 of the face portion 3820. As a result, the bridge structure 3660 may structurally reinforce the face portion 3820 by exerting force against the face portion 3820 by virtue of the bridge structure 3660 being compressed by the first protrusion 3610 and the second protrusion 3620. In one example, the bridge structure 3660 may exert a continuous and simultaneous force (e.g., tension) against the face portion 3820 having a toe-ward component and a heel-ward component as is generally represented by force arrows 3670 and 3675, respectively. In this manner, the face portion 3820 may have reduced elasticity, or said differently, the face portion 3820 may exhibit a reduced spring-like effect during impact. In practice, the bridge structure 3660 may have the effect of lowering the characteristic time (CT) of the golf club head 3800. Accordingly, by adopting the system 3600, the golf club head 3800 or any other example golf club head may be constructed with a relatively thinner face portion 3820 to increase the CT toward the legal limit established by the rules of golf while maintaining structural integrity through repeated impacts. Compared to a golf club head having a similar CT but lacking the bridge structure, the relatively thinner face portion 3820 of the present example may exhibit an improved COR when impacting a golf ball thereby producing higher ball speeds at similar CT values. The apparatus, methods, and articles of manufacture described herein are not limited in this regard.

The bridge structure 3660 may be made from a single material or multiple materials. In one example, the bridge structure 3660 may be made from a composite material. In another example, the bridge structure 3660 may be made from a high strength polymer material. In another example, the bridge structure 3660 may be made from a metallic alloy. In yet another example, the bridge structure 3660 may be made with a plurality of layers having similar or different materials. In one example, the bridge structure 3660 may be frictionally engaged to the first protrusion 3610 and the second protrusion 3620. Additionally or alternatively, the bridge structure 3660 may be secured to the first protrusion 3610 and the second protrusion 3620 using adhesive and/or mechanical fasteners. In another example, the bridge structure 3660 may be directly attached to the rear surface 3810 of the face portion 3820 without the use of the first protrusion 3610 or the second protrusion 3620 by welding, with one or more adhesives, and/or with fasteners. The bridge structure 3660 may be configured as a strip having uniform or variable thickness and uniform or variable width. In one example, the bridge structure 3660 may gradually reduce in thickness toward the first end portion 4010 and the second end portion 4020. In another example, the bridge structure 3660 may gradually reduce in width toward the first end portion 4010 and the second end portion 4020. The bridge structure 3660 may be assembled to the golf club head 3800 by inserting one of the end portions (e.g., first end portion 4010) into the receptacle (first receptacle 3910) of the corresponding protrusion (e.g., first protrusion 3610) followed by inserting the other end portion (e.g., second end portion 4020) into the receptacle (e.g., second receptacle 3920) of the remaining protrusion (e.g., second protrusion 3620), or vice versa. Based on the length of the bridge structure 3660, an individual may be required to compress the bridge structure 3660 into a flexed or bowed position in order to assemble the bridge structure 3660 to the first and second protrusions 3610 and 3620. In such instances, the bridge structure 3660 may be frictionally engaged to the first and second protrusions 3610 and 3620 and applies a continuous force (e.g., tension) against the face portion 3820. Additionally or alternatively, an adhesive and/or mechanical fasteners may be employed to secure the bridge structure 3660 to the first and second protrusions 3610 and 3620. By adjusting the structural characteristics (e.g., material composition, length, width, thickness, etc.) of the bridge structure 3660, a variety of CT and COR values may be achieved to impart additional club head performance and club head design options. The apparatus, methods, and articles of manufacture described herein are not limited in this regard.

Figure 42:
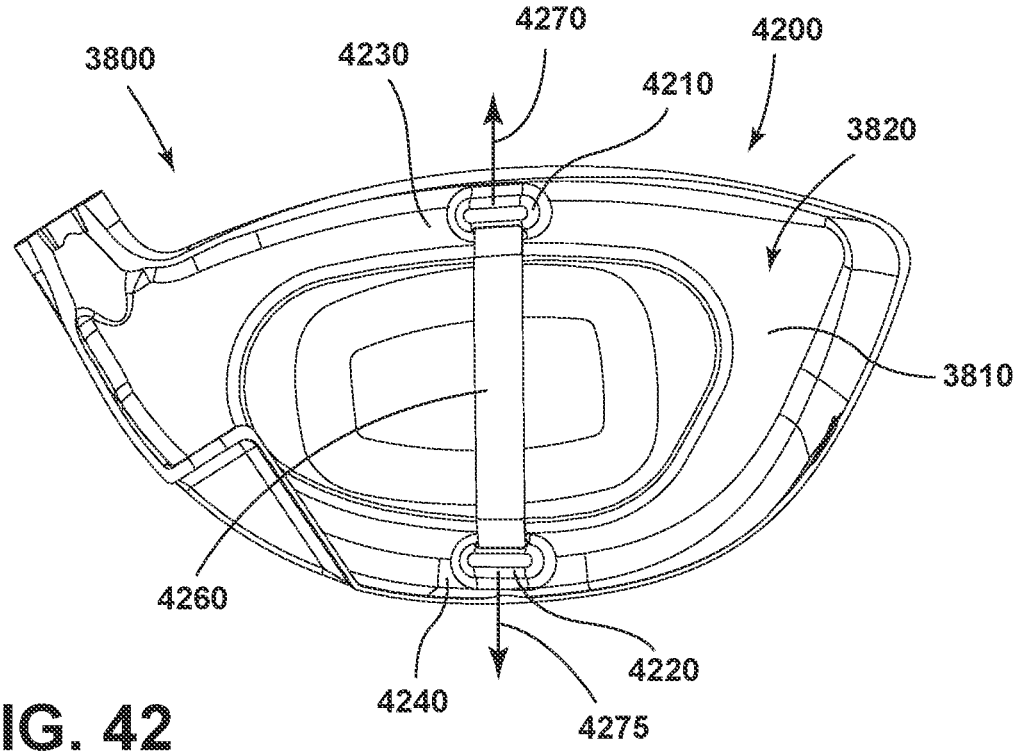
FIG. 42 illustrates the golf club head of FIG. 36 incorporating another system for improving COR according to an embodiment of the apparatus, methods, and articles of manufacturing described herein.

Referring to FIG. 42, the golf club head 3800 is depicted incorporating another example of a system 4200 for improving COR. In the illustrated example, a first protrusion 4210 and a second protrusion 4220 may be coupled to the rear surface 3810 of the face portion 3820. The first protrusion 4210 and the second protrusion 4220 may be located at a top-side portion 4230 and a bottom-side portion 4240 of the rear surface 3810, respectively. Accordingly, the first protrusion 4210 may be also referred to herein as the top-side protrusion, and the second protrusion 4220 may be also referred to herein as the bottom-side protrusion. The first protrusion 4210 and the second protrusion 4220 may be similar in many respects to the first protrusion 3610 and the second protrusion 3620 described herein with reference to the example system 3600 of FIGS. 36-41. A bridge structure 4260 extending vertically in a top-to-bottom direction may be assembled to the first protrusion 4210 and the second protrusion 4220 in the manner described with reference to the example of FIGS. 36-41. The bridge structure 4260 may be similar in many respects to the bridge structure 3660 described herein with reference to the example of FIGS. 36-41. For example, the bridge structure 4260 may have a length determined such that the bridge structure 4260 is maintained in a compressed position when assembled to the first protrusion 4210 and the second protrusion 4220. In the assembled state, the bridge structure 4260 may exhibit increased bowing in a direction away from the rear surface 3810 of the face portion 3820. The bridge structure 4260 may structurally reinforce the face portion 3820 by exerting a simultaneous and continuous force (e.g., tension) against the face portion 3820 having an upward component and a downward component as is generally represented by force arrows 4270 and 4275, respectfully. Similar to the example of FIGS. 36-41, the golf club head 3800 incorporating the system 4200 of the present example may be constructed with a thinner face portion 3820 to increase COR while maintaining structural integrity and a CT that conforms to the rules of golf. Accordingly, the golf club head 3800 may generate higher ball speeds relative to a golf club head having a similar CT value but lacking the system 4200 described herein. The apparatus, methods, and articles of manufacture described herein are not limited in this regard.

Figure 43:
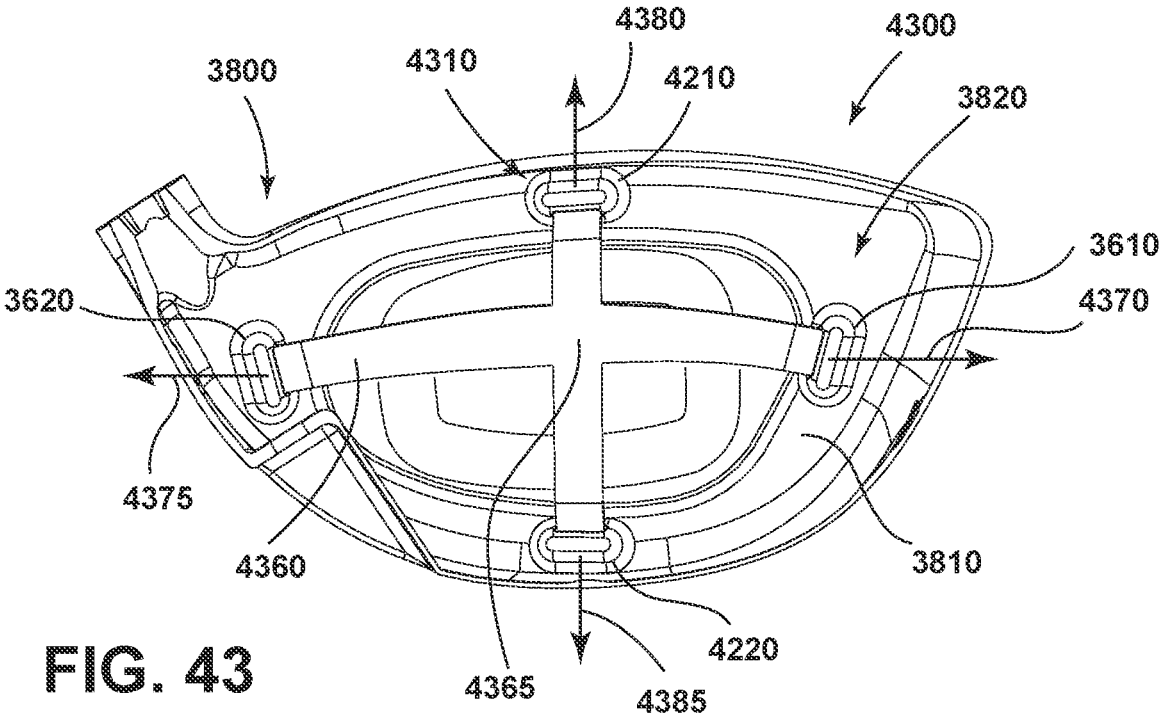
FIG. 43 illustrates the golf club head of FIG. 36 incorporating yet another system for improving COR according to an embodiment of the apparatus, methods, and articles of manufacturing described herein.

Referring to FIG. 43, the golf club head 3800 is depicted incorporating yet another example of a system 4300 for improving COR. In the illustrated example, a plurality of protrusions 4310 may be coupled to the rear surface 3810 of the face portion 3820. The plurality of protrusions 4310 are exemplarily depicted as the toe-side protrusion 3610 and the heel-side protrusion 3620 described in reference to the example of FIGS. 36-41 and the top-side protrusion 4210 and the bottom-side protrusion 4220 described in reference to the example of FIG. 42. A bridge structure 4360 may be assembled to the plurality of protrusions 4310 in the manner described with reference to the example of FIGS. 36-40 and the example of FIG. 42. The bridge structure 4360 may be T-shaped and proportioned such that the bridge structure 4360 is maintained in a compressed position when assembled to the plurality of protrusions 4310. In the assembled state, the bridge structure 4360 may exhibit increased bowing in a direction away from the rear surface 3810 of the face portion 3820. The bridge structure 4360 may include a central portion 4365 that decreases in thickness toward each of its terminal ends. The bridge structure 4360 may structurally reinforce the face portion 3820 by exerting a simultaneous and continuous force (e.g., tension) against the face portion 3820 having a toe-ward component, a heel-ward component, an upward component, and a downward component as is generally represented by force arrows 4370, 4375, 4380, and 4385, respectfully. Similar to the example of FIGS. 36-41 and the example of FIG. 42, the golf club head 3800 incorporating the system 4300 of the present example may be constructed with a thinner face portion 3820 to improve COR while maintaining structural integrity and a CT that conforms to the Rules of Golf. Accordingly, the golf club head 3800 may generate higher ball speeds relative to a golf club head having a similar CT value but lacking the system 4300 described herein. The apparatus, methods, and articles of manufacture described herein are not limited in this regard.

A system for improving COR as described herein may include a plurality of one or more bridge structures in any configuration. In one example, a system for improving COR may include a bridge structure that extends diagonally across the rear surface 3810 of the face portion 3820. In another example, a system for improving COR may include two diagonally oriented and intersecting bridge structures coupled to the rear surface 3810 of the face portion 3820. The diagonally oriented bridge structures may be separate and overlapping bridge structures or joined at a center portion similar to the bridge structure 4360 of FIG. 43. In another example, a system for improving COR may include a plurality of bridge structures (i.e., greater than two bridge structures) that may be centrally joined and extend radially from the centrally joined location toward the outskirts of the rear surface 3810 of the face portion 3820. In another example, a system for improving COR may include a plurality of bridge structures arranged in a mesh formation. In yet another example, a system for improving COR may include a plurality of concentric circular or elliptical bridge structures that may be connected. Thus, a system for improving COR as described herein may include any bridge structure configuration that may allow the golf club head 3800 to be constructed with a thinner face portion 3820 to improve COR while maintaining structural integrity and a CT that conforms to the Rules of Golf. The apparatus, methods, and articles of manufacture described herein are not limited in this regard.

Figure 44:
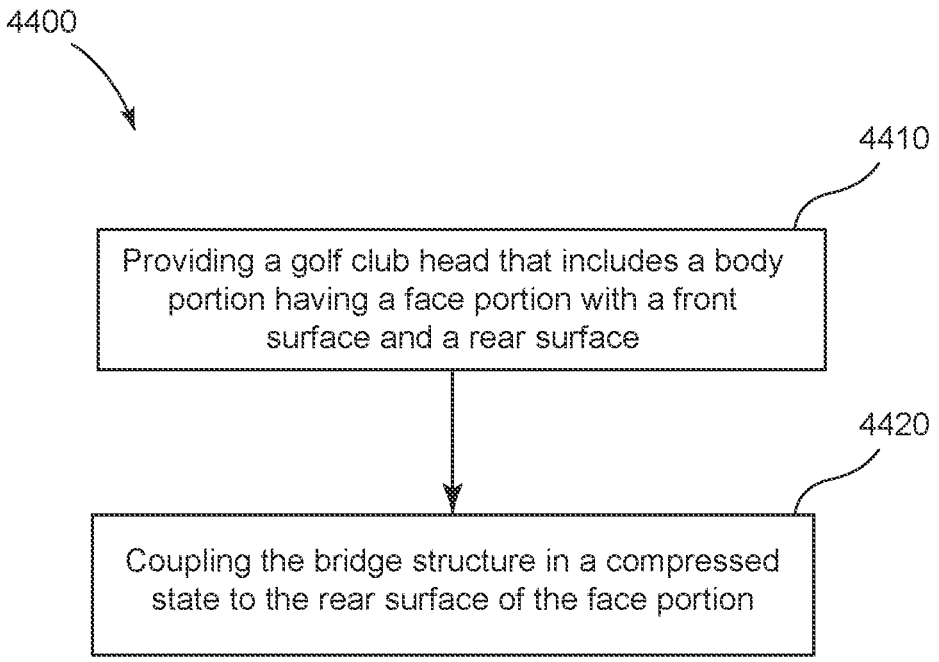
FIG. 44 depicts a process for improving a COR of a golf club head according to an embodiment of the apparatus, methods, and articles of manufacturing described herein.

FIG. 44 depicts a process 4400 for improving the COR of the golf club head 3800 or any other golf club head described herein. For purposes of understanding, the process 4400 is detailed herein with respect to the example system 3600 of FIGS. 36-41 for improving COR. However, the process may be similarly adopted with respect to the example systems 4200 and 4300 of FIGS. 42 and 43, respectively. The process 4400 may include providing a golf club head 3800 that includes a face portion 3820 with a front surface 3830 and a rear surface 3810 (block 4410). A bridge structure 3660 may be coupled in a compressed state to the rear surface 3810 of the face portion 3820 (block 4420). In one example, as described herein, the coupling of the bridge structure 3660 to the rear surface 3810 may include providing a first protrusion 3610 and a second protrusion 3620 at the rear surface 3810 of the face portion 3820 and assembling the bridge structure 3660 to the first protrusion 3610 and the second protrusion 3620. In one example, the bridge structure 3660 may be received through an opening (e.g., at the top, bottom, and/or rear of the golf club head 3800). Next, a first end portion 4010 of the bridge structure 3660 may be received (e.g., frictionally engaged) inside a first receptacle 3910 of the first protrusion 3610 followed by a second end portion 4020 of the bridge structure 3660 received (e.g., frictionally engaged) inside a second receptacle 3920 of the second protrusion 3620. The first protrusion 3610 and the second protrusion 3620 may maintain the bridge structure 3660 in a compressed position such that the bridge structure 3660 reinforces the face portion 3820 by exerting a force (e.g., tension) against the face portion 3820. In one example, the force exerted against the face portion 3820 by the bridge structure 3660 may have a toe-ward component and a heel-ward component. As described herein, the golf club head 3800 incorporating any of the example systems 3600, 4200, and 4300 may be constructed with a thinner face portion 3820 to improve COR while maintaining structural integrity and a CT that conforms to the Rules of Golf. Accordingly, the golf club head 3800 may generate higher ball speeds relative to a golf club head having a similar CT value but lacking the systems 3600, 4200, and 4300 described herein. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A method of manufacturing a golf club head, the method comprising:

(a) providing a body portion comprising an interior cavity, a front portion, a rear portion, a toe portion, a heel portion, a sole portion, a top portion, and a face portion at the front portion having a face opening;

(b) attaching a face plate portion to the face portion to cover the face opening and enclose the interior cavity, the face plate portion comprising a front surface configured to strike a golf ball, a back surface in the interior cavity, a recessed portion at a center portion of the back surface, and a perimeter portion between the center portion and the face opening;

(c) inserting at least a portion of a face insert portion in the recessed portion to couple the face insert portion to the face plate portion;

(d) forming a face bracket portion to include at least one bracket arm;

(e) coupling the face bracket portion to the face insert portion; and (f) attaching the face bracket portion to the face plate portion, wherein attaching the face bracket portion to the face plate portion comprises welding end portions of the at least one bracket arm to the perimeter portion of the face plate portion.

2. A method of manufacturing a golf club head as defined in claim 1 further comprising forming the face insert portion from a composite material.

3. A method of manufacturing a golf club head as defined in claim 1 further comprising applying an adhesive in the recessed portion to attach the face insert portion in the recessed portion.

4. A method of manufacturing a golf club head as defined in claim 1 further comprising:

forming the face insert portion to include a plurality of channels; and forming the face bracket portion to include a plurality of bracket arms, wherein each channel of the plurality of channels is configured to receive a bracket arm of the plurality of bracket arms of the face bracket portion.

5. A method of manufacturing a golf club head as defined in claim 1 further comprising applying an adhesive to the face insert portion to attach the face bracket portion to the face insert portion.

6. A method of manufacturing a golf club head as defined in claim 1 further comprising forming an elastic polymer insert, and coupling the elastic polymer insert to the body portion inside the interior cavity.

7. A method of manufacturing a golf club head as defined in claim 1 further comprising forming a crown portion of the top portion from a composite material.

8. A method of manufacturing a golf club head as defined in claim 1 further comprising forming a port on the sole portion and inserting a mass portion in the port to close the port, wherein the mass portion comprises a material having a greater density than a density of a material of the body portion.

9. A method of manufacturing a golf club head, the method comprising:

(a) providing a body portion comprising an interior cavity, a front portion, a rear portion, a toe portion, a heel portion, a sole portion, a top portion, and a face portion at the front portion having a face opening;

(b) attaching a face plate portion to the face portion to cover the face opening and enclose the interior cavity, the face plate portion comprising a front surface configured to strike a golf ball, a back surface in the interior cavity, a recessed portion at a center portion of the back surface, and a perimeter portion between the center portion and the face opening;

(c) forming a face insert portion to include a plurality of channels;

(d) forming a face bracket portion to include a plurality of bracket arms;

(e) inserting at least a portion of the face insert portion in the recessed portion to couple the face insert portion to the face plate portion;

(f) coupling the face bracket portion to the face insert portion; and (g) attaching the face bracket portion to the face plate portion, wherein each channel of the plurality of channels is configured to receive a bracket arm of the plurality of bracket arms of the face bracket portion.

10. A method of manufacturing a golf club head as defined in claim 9 further comprising forming the face insert portion from a composite material.

11. A method of manufacturing a golf club head as defined in claim 9 further comprising applying an adhesive in the recessed portion to attach the face insert portion in the recessed portion.

12. A method of manufacturing a golf club head as defined in claim 9 further comprising applying an adhesive to the face insert portion to attach the face bracket portion to the face insert portion.

13. A method of manufacturing a golf club head as defined in claim 9 further comprising forming an elastic polymer insert, and coupling the elastic polymer insert to the body portion inside the interior cavity.

14. A method of manufacturing a golf club head as defined in claim 9 further comprising forming a crown portion of the top portion from a composite material.

15. A method of manufacturing a golf club head, the method comprising:

(a) providing a body portion comprising an interior cavity, a front portion, a rear portion, a toe portion, a heel portion, a sole portion, a top portion, and a face portion at the front portion having a face opening;

(b) attaching a face plate portion to the face portion to cover the face opening, the face plate portion comprising a front surface a back surface in the interior cavity, a recessed portion at a center portion of the back surface, and a perimeter portion between the center portion and the face opening;

(c) forming a face insert portion;

(d) forming a face bracket portion to include a plurality of bracket arms;

(e) inserting at least a portion of the face insert portion in the recessed portion to couple the face insert portion to the face plate portion;

(f) coupling the face bracket portion to the face insert portion; and (g) welding end portions of each bracket arm of the plurality of bracket arms to the perimeter portion of the face plate portion.

16. A method of manufacturing a golf club head as defined in claim 15 further comprising forming the face insert portion from a composite material.

17. A method of manufacturing a golf club head as defined in claim 15 further comprising applying an adhesive in the recessed portion to attach the face insert portion in the recessed portion.

18. A method of manufacturing a golf club head as defined in claim 15 further comprising applying an adhesive to the face insert portion to attach the face bracket portion to the face insert portion.

19. A method of manufacturing a golf club head as defined in claim 15 further comprising forming an elastic polymer insert, and coupling the elastic polymer insert to the body portion inside the interior cavity.

20. A method of manufacturing a golf club head as defined in claim 15 further comprising forming a crown portion of the top portion from a composite material.

* * * * *